US010006445B2

(12) United States Patent
Haque

(10) Patent No.: US 10,006,445 B2
(45) Date of Patent: Jun. 26, 2018

(54) METHOD AND SYSTEM FOR A PROGRAMMABLE AND FAULT TOLERANT PULSED PLASMA THRUSTER

(71) Applicant: The George Washington University, Washington, DC (US)

(72) Inventor: Samudra Haque, Washington, DC (US)

(73) Assignee: The George Washington University, Washington, DC (US)

( * ) Notice: Subject to any disclaimer, the term of this patent is extended or adjusted under 35 U.S.C. 154(b) by 1077 days.

(21) Appl. No.: 14/462,127

(22) Filed: Aug. 18, 2014

(65) Prior Publication Data

US 2016/0047364 A1 Feb. 18, 2016
US 2017/0191472 A9 Jul. 6, 2017

Related U.S. Application Data

(60) Provisional application No. 61/941,244, filed on Feb. 18, 2014.

(51) Int. Cl.
*F03H 1/00* (2006.01)

(52) U.S. Cl.
CPC ..... *F03H 1/0087* (2013.01); *F03H 1/0018* (2013.01)

(58) Field of Classification Search
CPC .... F03H 1/0087; F03H 1/0018; F03H 1/0006; F03H 1/0012; F03H 1/0037; F03H 1/0043; F03H 1/005; F03H 1/0056; F03H 1/0062; F03H 1/0068; F03H 1/0075; F03H 1/0081; F03H 1/0093; B64G 1/42; B64G 1/428; B64G 1/405; B64G 1/406
See application file for complete search history.

(56) References Cited

U.S. PATENT DOCUMENTS 4,161,780 A 7/1979 Rudolph et al.
4,600,895 A 7/1986 Landsman
5,310,143 A 5/1994 Yocum et al.
5,369,564 A 11/1994 Choi
(Continued)

OTHER PUBLICATIONS

Keidar "Micro-Cathode Arc Thruster Development and Characterization" 2011.*

(Continued)

*Primary Examiner* — William H Rodriguez
*Assistant Examiner* — William Breazeal
(74) *Attorney, Agent, or Firm* — Blank Rome LLP

(57) ABSTRACT

A system and method provides a fault-tolerant multi-channel pulsed plasma thruster system utilizing a control unit and an embedded real time application manipulating low-level timing events with programming, with clear examples of completely flexible control techniques of a scalable micropropulsion system having many pulsed plasma thruster channels, taking into account system aging behavior and specific mission utilization requirements that may change in the mission lifetime. The system and method also covers an architecture lending itself suitable for design of a dedicated FGPA or ASIC that would tightly integrate many channels of thruster components to build a robust, resilient and versatile micropropulsion subsystem for space applications, and indirectly for advanced multi-channel spacecraft instrumentation.

13 Claims, 10 Drawing Sheets

(56) References Cited

U.S. PATENT DOCUMENTS

| | | | | |
|---|---|---|---|---|
| 5,947,421 | A | 9/1999 | Beattie et al. | |
| 6,581,880 | B2 | 6/2003 | Randolph et al. | |
| 6,735,935 | B2 | 5/2004 | Hruby et al. | |
| 6,818,853 | B1 | 11/2004 | Schein et al. | |
| 7,053,333 | B1 | 5/2006 | Schein et al. | |
| 7,518,085 | B1 | 4/2009 | Krishnan | |
| 8,019,493 | B1 | 9/2011 | Weigl et al. | |
| 2010/0121552 | A1 | 5/2010 | Le Gonidec et al. | |
| 2011/0258981 | A1 | 10/2011 | Keidar et al. | |
| 2014/0137537 | A1* | 5/2014 | Stickelmaier | B64G 1/428 60/202 |
| 2016/0032906 | A1* | 2/2016 | Leskosek | F03H 1/0012 60/203.1 |

OTHER PUBLICATIONS

Corey "Electric Propulsion at Space Systems/Loral" 2009.*
NASA "Spacecraft Subsystem Functions" 2008.*
Keidar "Micro-Cathode Arc Thruster (mCAT) with thrust vector control" 2012.*
Grasso "Command and Sequencing Technology for Small Body Missions" 2008.*
Daniels "Dual Output Power Supply Sequencing for High Performance Processors" 2002.*

* cited by examiner

METHOD AND SYSTEM FOR A PROGRAMMABLE AND FAULT TOLERANT PULSED PLASMA THRUSTER

RELATED APPLICATIONS

This application claims the benefit of U.S. Provisional Application No. 61/941,244, filed Feb. 18, 2014, the entire contents of which are incorporated herein by reference.

BACKGROUND OF THE INVENTION

Field of the Invention

The present invention relates to pulsed plasma thruster systems. More particularly, the present invention relates to the field of engineering to develop a programmable and fault tolerant pulsed plasma thruster apparatus/system that can produce impulse-bits from a set of pulsed plasma thrusters, and that can be managed at the system component levels to provide redundancy features while allowing timing control of the impulse-bit production and monitoring functions at fractions of a single pulse time period.

Background of the Related Art

There is a broad area of pulsed propulsion system design, incorporating pulsed chemical thrusters, pulsed electric propulsion/micro-propulsion systems, pulsed plasma thruster, vacuum arc plasma thrusters, micro-cathode arc thrusters, and similar micropropulsion systems imparting small bursts of thrust, in the form of 'impulse-bits'. The units of impulse-bits, is exactly similar to the unit of impulse, which is the product of a force F, and the time t, for which it acts. An example impulse-bit unit commonly seen in micropropulsion application is that of Micro-Newton Seconds, or μNs. Another definition of Impulse-Bit is that it is the smallest change in momentum required to allow for fine attitude and orbit control of a spacecraft.

Certain propulsion systems have control systems that use continuous series of rectangular trigger pulses (singular or plural arrangement) as control signals to actuate a system that produces impulse-bits, on the basis of rising/falling edges of an external trigger, and accuracy in the timing of impulse-bit generation is usually on the order of a full impulse-bit timing period, or allowed to drift due to the complex processes in generating plasma arc discharges.

Examples of arc thrusters are shown, for instance, in U.S. Patent No. Publ. 2011/0258981 to Keidar, and U.S. Pat. No. 6,818,853 to Schein. The thrusters are actuated, and produce impulse-bits, by the rapid discharge of medium current, low-voltage, micro-second scale energy pulses delivered at the anode-cathode terminals of a thruster device. The Plasma Power Unit (PPU) is utilized to store energy in regular timed intervals and to discharge the same energy in an extremely brief period, at a medium current level, based upon the time constants that can be calculated from fundamental electrical properties of the electrical energy/inductive-magnetic energy circuitry. In this invention, a driver trigger pulse is required to activate the PPU, and it is assumed that multiple channels in a set of thrusters (each, employing their own PPU, or a shared PPU) will be triggered with rectangular individual pulses. Minute adjustment of the triggers, within the time span of a single cycle, is not considered at the pulse-by-pulse level in both patents. The driver trigger pulses are generated in a simple manner, with the in nature and the timing/pulse-width duty cycle for any system chosen to match the physical response times of the PPU resistance, capacitance, inductor and power switching elements, typically after series of experimental trials, and this is due in part to the degree of difficulty observed in experimental trials to ensure that each external trigger event produces an equal and precise plasma impulse-bit output from the system. Possible impulse-bit variation due to minute variation in component values of the PPU circuit or electrical/thermal/mechanical behavior of the thruster head after repeated operations, and over lifetime of the components, is not given adequate consideration.

In any Vacuum Arc Thruster system, the efficiency and the thrust power levels that can be generated from each impulse-bit operation depends upon the pulse-width modulated energy from the PPU being discharged to the anode/cathode terminals of the thrusters. If the anode-cathode interfaces and thruster are completely enclosed in a standalone container, with only mechanical and passive elements, and a connection to a separate PPU, at any distance, they can then be referred to as 'thruster-heads', but in previous Keidar and Shein patent documentation, such a thruster-head has also been referred to as 'thruster'. For the purposes of this document, Thruster-Head will refer to the stand-alone thruster device, whereas Thruster Channel will be used to refer to a combination of at least one PPU, at least one Thruster-Head, and any intermediary wiring. A 'Thruster' therefore will always be considered to be equivalent to a Thruster-Head, and be a vital part of a Thruster Channel.

The force represented by impulse-bit value that can be generated from a Thruster Head mechanism is a complex function of electrical and mechanical properties of the anode/cathode materials, their physical separation, the presence of a suitable impregnated catalyst, as insulator, to achieve micro-plasma, leading to generation of the actual plasma flow. The production process is also convoluted, due to the random "walking" motion of the rotating cathode spot and surface irregularities where the propulsion material being ablated. Once the plasma arc discharge process is underway, cathode terminal matter is converted from solid to plasma state and departs the discharge zone at high velocities at right angles to the electrical and magnetic fields. Detailed behavior of plasma thrusters are described in the Keidar and Schein patents.

Precision timing control of thruster operation of a spacecraft is vital for space missions, and also difficult to achieve due to the nature of the physical processes for generating thrust from a propellant and the available mechanisms to control that production (of thrust) effectively when only a small amount of impulse is desired. When a thruster fires longer (or more powerful), or shorter (or less powerful) than required by the calculations of a spacecraft dynamics computer, an error can be calculated and the next cycle of thruster operations has to be adjusted to minimize the cumulative error, towards acceptable limits, over a series of thruster firings. Onboard calculation of such error basis requires a suitable feedback mechanism indicating when a thruster has fired, in cue with a determination system that precisely estimates the position/attitude of the spacecraft, and perhaps a calibration guideline to indicate how far the measurements are off nominal values.

In U.S. Pat. No. 8,019,493 to Weigl et al., a spacecraft thruster torque 'feedforward' calibration system is discussed in which a plurality of thrusters (of an indeterminate nature) are triggered by firing commands and the resultant error is used to create a lookup table that would be used to create torque calibration. The reduction of total attitude error to micro-radian levels is performed by adjusting the thruster firing of future cycles by accommodating both measured and calibrated values of previous firings, using a dynamically updated table that has to be maintained between firings, per thruster set. Control methods are asserted in a manner that focuses on the triggering of the thruster, and measuring errors that occur afterwards, although fine adjustment of the trigger mechanism within a fractional time span of a single cycle, or programmable adjustment to account for further changes in system behavior would be a useful addition to this invention. The Weigl patent indicates the importance of measuring, analyzing and calculating the eventual time mark, and eventual force levels at which the thruster produced an impulse-bit, or impulse, and use that to as a prediction/correcting factor for future thruster firings.

Electric propulsion systems require different control mechanisms than Chemical propulsion systems. Chemical propulsion is used in the vast majority of launch vehicle rocket systems and missiles. There are occasional use-cases where a common need between the two domains can be identified, with regard to the production of several impulse-bits. Any thruster propulsion system has a certain inherent processing delay and processing characteristics that may change over time and exhibit different behavior in different modes of operation, and then there is a need to synchronize key events (e.g. a firing trigger, on-off states, fuel flow etc.). It would be beneficial to develop a method to fine tune the timing of the trigger signals so that the effective production time mark of the impulse-bit can be adjusted to account for potential system changes, after operating for repeated cycles and duration. In U.S. Patent Publ. No. 2010/0121552 to Le Gonidec et al., an engine is adjusted by the use of slow valves, to bring the rocket engine to the operating point that complies with the set points, and so as to keep it there. In the Le Gonidec publication, a fine adjustment method, precise to within a small fraction of a single impulse-bit pulse cycle is described.

A vacuum arc thruster as described in U.S. Pat. No. 7,518,085 to Krishnan, is actuated by using a combination capacitive driver and inductive-energy storage system to generate a voltage breakdown across a very small gap at a fairly constant voltage, in pulses at the millisecond and microsecond scale, which are triggered with digital logic. The combination of a single PPU is considered for both single-thruster head per channel, or multi-thruster-head per channel use. Different geometry possibilities are explained, and throttle control is proposed by changing the repetition rate of the trigger pulse, or changing the duty cycle of current applied to the energy storage element is covered. Synchronization between individual PPU of a set of PPU of this invention is not discussed by Krishnan. In the accompanying U.S. Pat. No. 7,053,333 to Schein et al., associated with the aforesaid Krishnan vacuum arc thruster patent, a switched trigger pulse (referred as SW_ON) is utilized/ Similarly, in an earlier pulsed thruster system, described in U.S. Pat. No. 6,735,935 to Hruby et al., the operation of a control unit which drives a processing unit or propellant storage and delivery system, or both of them, is discussed with two types of constraints: repetitive pulse widths having constant duration, frequency, or constant duration and variable frequency. In neither of the above mentioned patents and patent applications has the possibility of a fractional unit of impulse-bit, say 1.5 impulse-bits production requirement be considered, rather than in whole impulse-bit units like 1, 2, 3, . . . any number of integer units.

A spacecraft is usually power limited, and also constrained in power storage capability. Arc thrusters are mostly power hungry devices. With respect to the all-important energy needs of such an electric propulsion system, there is a well-recognized need to manage energy budget effectively to maintain electric propulsion thruster operation in a pulsed/continuous mode. For example, in U.S. Pat. No. 6,581,880 to Randolph et al., burn times, as calculated using orbit analysis, are used as a control variable and compared to a power analysis that results in determination of allowed thruster voltage, current and power draw, and a maximum period in which the EP device can be operated before it is shutdown. This method works when a single EP device is used, however, in a bank of EP devices an additional synchronization fabric and logic switching will surely need to be implemented in order to smooth the maximum load on the spacecraft circuits, and that possibility does not seem to be presented in the patent. The lack of consideration of the possible benefits or requirements for fine adjustment of the operation of a set of pulsed thrusters is also seen in other earlier electric propulsion inventions, an example of which is U.S. Pat. No. 5,947,421 to Beattie et al., where it is succinctly described that the invention is particularly suited for spacecraft in which only one thruster is fired at any given time.

If the scope of investigation is now shifted to reviewing three axis thruster modulation inventions, such as can be seen in U.S. Pat. No. 5,310,143 to Yocum et al., a thruster select and timing logic requirement is described in general terms, where it is succinctly admitted that the issue is, "a difficult task", and that there many ways to accomplish such functions. It is also stated that a precise method is not part of the invention, and that any such type of control (e.g., select and timing logic) would have to have the ability to use spacecraft mass properties with thruster placement and alignment information to select thrusters and compute the necessary on-time commands. It is stated that only then, can the on-times be adjusted to fit the system timing characteristics, allowing for the possibility of multiple thrusters in use simultaneously, but no explicit argument is made for implementing fine synchronization of thruster operations at fractions of time smaller than the invention's sample period, which is necessary to ensure precision operation of a multi-channel thruster application. Adjusting time marks in fractions of a impulse-bit time-period is a necessary part of a process to ensure higher degrees of precision in spacecraft operations.

On the other hand, one example of a method for fine adjustment of multiple trigger signals that need to be 'phased' in relation to key events can be seen in U.S. Pat. No. 5,369,564 to Choi, and the invention example concerns a phase-difference synchronization controlling circuit of a power circuit for operating in parallel two or more switched mode power supplies. While the example invention does not claim any application to the operation of a vacuum arc thruster, it lends itself to the understanding by any skilled in the electrical domain that a spacecraft PPU for a pulsed plasma thruster could be logically treated as a complex power conversion system, almost like a switched mode power supply where power input is 'processed' and 'converted' to a power output, in functionality, and therefore could be treated as a device where the operation of its various parts can be minutely adjusted to provide any preferred 'mode'.

In the general area of time-based triggering, an example of such an invention in which the delayed signal closest in time to a reference signal (or, key event), is selected as the output signal, is seen in U.S. Pat. No. 4,600,895 to Landsman. But for a spacecraft utilizing vacuum arc thrusters that may need minute adjustment in their operation across a time-window, throughout their long duration lifetime expectancy, it can be estimated that there may be future situations where it will be necessary to adjust the triggering of the device(s) either before (a special case) or after a key events (more common case), and this dual requirement is not covered by Landsman. In addition, in the mentioned invention, no discussion is made of the possibility that there might have to be an independent high resolution timing reference source to establish a accurate time base for the fine adjustment of trigger pulse controlling plasma phenomena, that typically last only micro-seconds and smaller time intervals. It can therefore be stated that existing synchronization methods from other domains remain to be extended to the very precise domain of plasma engineering based vacuum arc thrusters and their derivative inventions, to allow fine precision operation. Such a utility invention would have the potential to benefit other inventions such as those described in U.S. Pat. No. 4,161,780 to Rudolph et al., where a requirement to precisely control the delayed firing of thruster jets to correct or adjust the attitude of a spinning spacecraft is detailed.

SUMMARY OF THE INVENTION

The present invention generally relates to methods by which the driver pulse signal of a pulsed plasma thruster PPU is adjusted appropriately to allow minute changes in the firing process of a single impulse-bit, where individual channels of a single/multi-channel, pulsed, electric propulsion system have to be triggered, as appropriate, to satisfy propulsive maneuver impulse-bit and delta-V maneuver goals of a spacecraft during its flight. The invention aids in the implementation of an additional fine level of control over the timing of the required driver trigger pulses (singular or plural arrangement).

It is of particular value to any control system of spacecraft thrusters that needs to be operated on a pulse-by-pulse basis as part of a standalone system (single channel) or a complex (multi-channel) propulsion/micro-propulsion subsystem, and the control of signals to other subsystems where other spacecraft mission tasks need to be precisely controlled in relation to the finely adjusted pulsed thruster output.

The invention also relates to controlling fine adjustments to be made to firing commands, again on a pulse-by-pulse basis, to account for actuation discrepancies in spacecraft propulsion subsystem operation behavior if they are noticed over time due to any number of factors such as: changes in the value of electronic component due to space environment, operating modes, consumable element utilization, unexpected phenomenon, physical location/geometry changes, mechanical issues, failure of key sections of the system or a need to intentionally phase the trigger pulse operation of such a system, in a particular way, to accommodate other spacecraft subsystem needs, with regards to the operation of a plasma thruster system.

The invention is particularly useful for spacecraft employed in extreme deep space missions requiring a stabilized quite precise attitude control for very long distance communications/sensor utilization (e.g., Jupiter to Earth, L1 points to Sun, L1 points to Earth) and also for planet observing remote sensing satellites who need to articulate sensor platforms or thrusters to achieve on-mission coverage.

These and other objects of the invention, as well as many of the intended advantages thereof, will become more readily apparent when reference is made to the following description, taken in conjunction with the accompanying drawings.

DETAILED DESCRIPTION OF THE PREFERRED EMBODIMENTS

Figure 1:
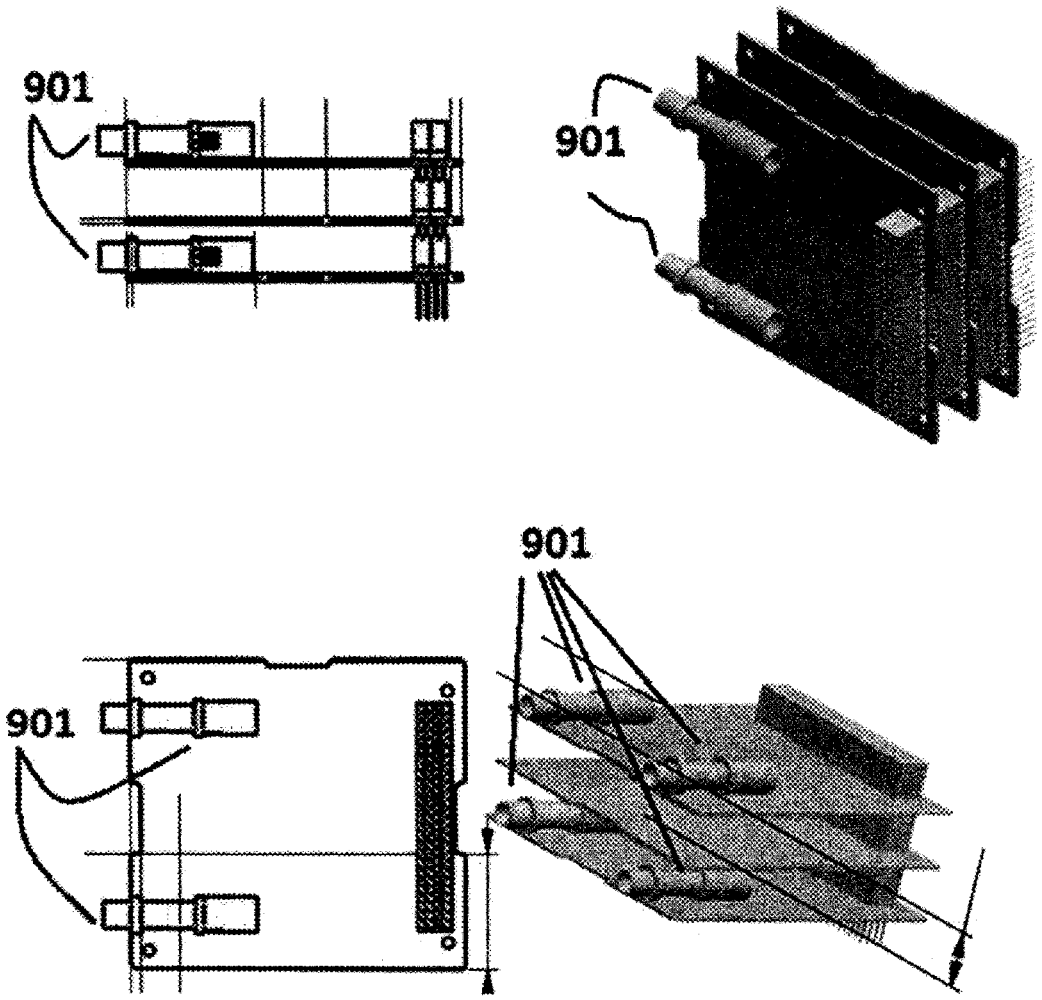
FIG. 1 shows a sample layout of quad-channel μCAT subsystem for a CubeSat form spacecraft.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents that operate in similar manner to accomplish a similar purpose. Several preferred embodiments of the invention are described for illustrative purposes, it being understood that the invention may be embodied in other forms not specifically shown in the drawings.

Figure 14:
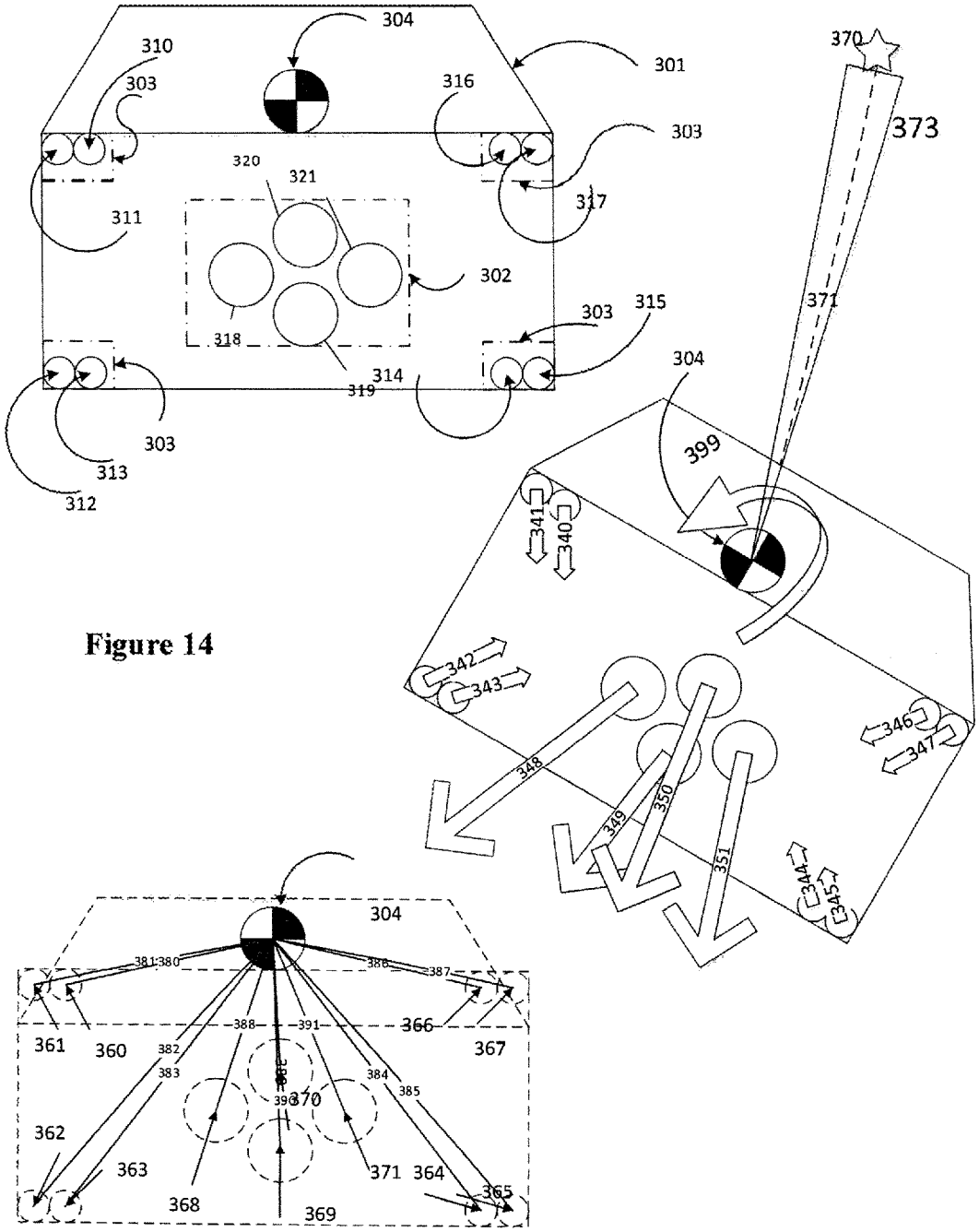
FIG. 14 is a diagram showing a layout of a spacecraft with multiple thrusters, and a diagram of potential torque production direction, and/or delta-V production direction.

In general, with reference to FIG. 14, when a coordinated set of electric propulsion thrusters (sometimes referred to as electric rockets), that operate in a pulsed manner are affixed to a spacecraft bus 301, they have to be selectively commanded to operate through the calculations of a dynamics controller/computer. This computer is programmed with code derived from the discipline of Guidance, Navigation & Control subject area (not presented), and is often referred collectively as 'GN&C'. Thrusters can be grouped into functional sections such as Attitude Control Thrusters 303 or Main Propulsion 302, or other groups depending upon intended use such as Retro Rockets, Reaction control system, yaw/pitch/roll, etc.

All space missions requires occasional minute attitude correction procedures, at various points on its trajectory, to ensure the spacecraft vehicle is pointed with sufficient accuracy to a distant object to allow sensor coverage, communication coverage, solar power harvesting, or other reason based upon mission objectives. As an example, if it is desired to rotate the spacecraft around the center of mass 304 (centroid), towards a particular distant point in the sky 370, at desired a desired attitude 371, the selective choice of which combination of thruster heads 310, 311, 312, 313, 314, 315, 316, 317, 318, 319, 320, 321 can be used to turn the body of the vehicle is estimated from a dynamics analysis that is designed to produce a net torque produced by selectively combining torques 360, 361, 362, 363, 364, 365, 366, 367, 368, 369, 370, 371 which are themselves produced as a result of the forces 340, 341, 342, 343, 344, 345, 346, 347, 348, 349, 350, 351 acting at their corresponding distances from the spacecraft center of mass 304, which are 380-391 inclusive, for certain times. This net torque will have the effect of causing a rotation 399, of the spacecraft around its center of mass 304, and to be accurate has to be calculated with knowledge of the mechanical moments and products of inertia of the spacecraft at the maneuver time in conjunction with an estimate of external net forces due to space environment (e.g., drag, solar pressure, magnetic fields, etc.).

Separately, it may be necessary at a point in a space mission to have the spacecraft fly in a particular attitude, taking into consideration the power generation needs and the limits of travel of a photovoltaic solar panel attached to the vehicle, or a sensor array that has developed limitations, or a failure of one or more of its momentum exchange devices, or a failure in one of the thruster heads of a cluster/array/hybrid configuration, or an entire thruster channel. In these sample scenarios, only a few of the thrusters (e.g., selected from ACS Thrusters 310, 311, 312, 131, 314, 315, 316, 317) need to be activated on command, and also need to be modulated by adjusting the repetition rate, on-pulsing or off-pulsing a combination thereof. It may not be required to fire all thrusters in the selected set at once at all times, they may need to be fired in a specific sequence, with very little time (e.g. within timeframe of 10E-3 to 10E-6 seconds) intervals to create the desired force levels based upon the simple motion that the force is built up over several impulse-bits which could be 340, 341, 342, 343, 344, 345, 346, 347 in the ACS group 303, or from the main group 302, and selected choices of 34, 349, 350, 351.

The calculation of the quantity of thruster-heads, PPU, thruster channels, number of thruster-heads per cluster, number of clusters per channels, is based upon mission attitude correction and main propulsion requirements. There is no set formula, and designers will have to develop their own estimates taking into account, amongst other factors, available minimum and maximum mission electrical power levels, available physical volume, physical mass and spacecraft hard mounting points, redundancy schemes for multiple chains, redundancy schemes for multiple PPU, redundancy schemes for multiple thruster heads in a cluster, required minimum payload volume and mass, thruster propellant consumption rate and reserve requirements. In general, it should be able to calculate that there would be a maximum of M thrusters-heads (M=1, 2, . . . ) being connected to N PPU (N=1, 2, . . . ), and divided into either of the following configurations: Single Thruster Channel (nominally shown in FIG. 6), Array of Single Thruster Channels (nominally shown in FIG. 7), Cluster of Thruster Heads on a channel (nominally shown in FIG. 8), Hybrid Cluster/Array of Thruster Heads (nominally shown in FIG. 9). FIG. 1 shows a practical embodiment of a subsystem intended for low-earth orbit operations, in a CubeSat form spacecraft, with four Thruster Heads 901, of the same specification.

In all of the cases mentioned above, an important factor in dynamics calculations is the time the impulse-bit event was schedule to be produced, the time it was eventually produced, the duration of the impulse-bit production period, the force the impulse-bit was supposed to produce, the force the impulse-bit did produce, and the remaining life of the propulsion material in the thruster-head after the impulse-bit production has ended.

Omitting for the present moment, a discussion on variations of impulse-bit operations due to physical property changes of a thruster head mechanism and electrical property changes of a PPU, and other latency/variability due to a thruster channels interaction with other spacecraft subsystems, no thruster system can be realized to produce the exact thrust output, at the exact time, with the exact duration, at each and every instance of activation. It is natural that pointing errors will still be prevalent after the desired maneuver is executed, and space mission maneuvers are designed to accommodate some inaccuracy in the pointing estimation which results in a target region 373 being utilized rather than a target 307 in FIG. 13.

An example of how accurate a maneuver has to be, can be gleaned from NASA Cassini mission profile, which included a requirement that duration of a thruster firing had to be executed within about 0.1% of the planned duration, and the pointing direction is executed within about 7 milliradians (0.4 degrees). Another example might be useful to understand the extreme necessity to make minute or 'super-fine' adjustments in spacecraft attitude for deep space probes. A future space vehicle arriving at Neptune, may attempt to communicate with a deep space network antenna on Earth, at approximately 30 Astronomical Units (A.U.) heliocentric distance. The space vehicle would have to hold its attitude at a much more precise level than the Cassini mission, and have to have the ability to maintain attitude to less than 2.93E-6 radians (0.0001682 degrees) at times, if the Earth is in inferior conjunction with Neptune. While some of this precision could come from onboard momentum exchange actuators, a significant portion of the stability would have to come from pulsed thrusters operated in calculated modes.

On the other hand, with reference to FIG. 14, a delta-V effect, based upon the Rocket Equation, which causes changes in orbital velocity vector can be produced by adjusting the mass flow rate of propellant exhaust produced by the Main Propulsion 302 thruster set, which include thrusters 348-351 inclusive, and application of the well-known relationship between the velocity change ΔV, Rocket exhaust speed $v_e$ (of the propellant consumed during the maneuver) and the ratio of initial mass $m_0$ and final mass $m_f$ after the maneuver which is:

$$\Delta V = v_e \ln\left(\frac{m_0}{m_f}\right).$$

Here the errors in control such as inadequate performance from thruster 351, whereas thrusters 348, 349, 350 fire as planned, might result in serious trajectory maneuver missteps causing a spacecraft to miss its intended interplanetary target altogether if it cannot rendezvous at a particular point in space, and at a precise time, per its planned trajectory maneuver sequence. The difference may be as small as a few centimeters/second to several meters/second in delta-V built up over a period of thruster maneuvers, involving forces as low as a few micro-newtons to many newtons per impulse-bit. For example, employing only a main propulsion thruster bank producing 600 micro-newtons (1 Newton=force required to provide 1 m/s^2 of acceleration of a 1 Kg mass) of force, over a duration of a few weeks in intermittent operation around the Earth-Moon system, a 12 Kg mass spacecraft can be reliably accelerated to impart a cumulative velocity change ΔV of 1284 m/s, allowing it to be captured into Lunar orbit after being dropped off from a Lunar Flyby mission from a carrier space vehicle.

However as the spacecraft is actually heading to the projected location of a planetary body (Moon) from deep space, it has to be commanded by mission control to time those thruster operations such that the spacecraft arrives exactly when the planet does, at a prescribed altitude, otherwise the mission is likely to fail in the case of early arrival at the rendezvous point (too fast, spacecraft is not captured and leaves the vicinity into space) or late arrival (too slow, and the spacecraft either crashes into the planetary body or again misses the target). It is commonly seen that small (fine) adjustments of fractional meters of a second are often necessary trajectory correction maneuvers, but they have to be timed very accurately to have the desired effect.

It is therefore quite desirable to implement these control steps with sufficient precision such that the actuation of different members of the set of thrusters 310-321, in certain combinations and sequences, can be organized in a manner to achieve the required attitude control torques, or changes in the net orbital velocity as closely as possible to the calculated value.

Figure 6:
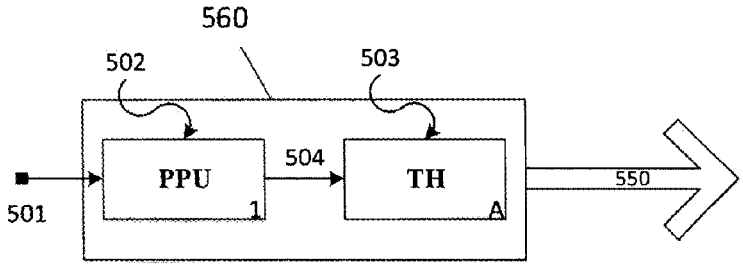
FIG. 6 shows a thruster channel, with PPU and Thruster Head.

It may be instructive to analyze thoroughly the operation of PPU units and Thruster Heads. With reference to a single Thruster Channel 560, as shown in FIG. 6, the impulse/force produced is periodic, in a pulse train, but primarily controlled by circuitry of PPU 502, which is triggered by a digital control signal 501. Almost all force calculations are based upon the average over time of several pulse (or impulse-bit) events, and not usually measured on an individual pulse basis.

Figure 2:
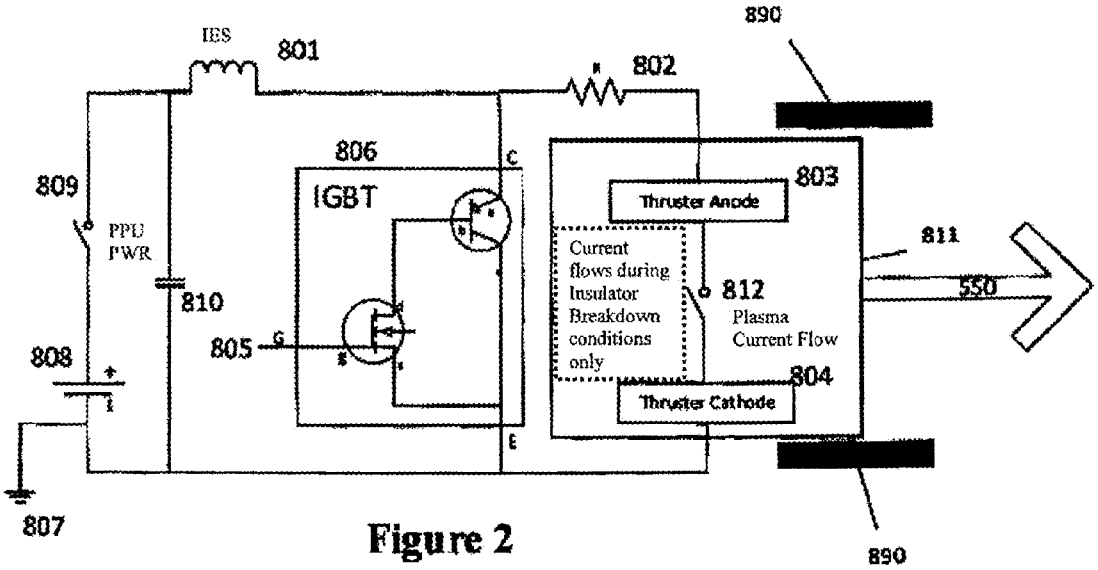
FIG. 2 is a circuit diagram showing a generic PPU with a generic thruster head.
Figure 15:
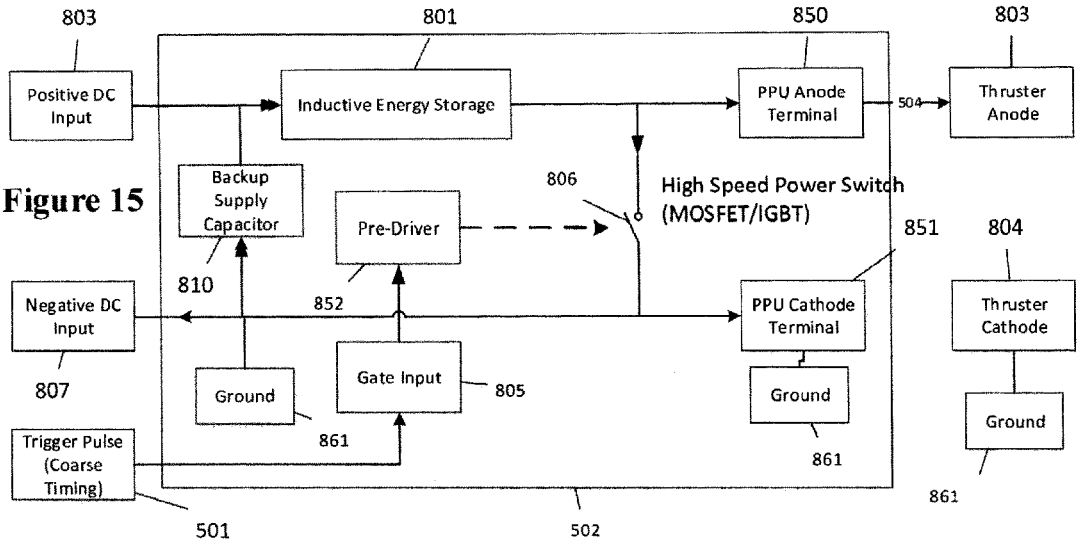
FIG. 15 is a block diagram of the sections of a generic PPU with coarse control.

Referring to FIG. 2, a generic PPU circuit schematic is shown, integral to PPU 502 of FIG. 6, and to aid this discussion, a block diagram of the same is shown in FIG. 15 (similar to prior art of Keidar Patent) where the PPU 502 is presented with connections to Positive DC input 803, Negative DC input 807, Driver trigger pulse 501 from an outside source, connections to Thruster Anode 803 and Thruster Cathode 804.

The PPU 502 system is split into sections: Inductive Energy Storage section 801 comprising an passive inductive element 801, connected in series with positive DC input 803, the C and E terminals of the IGBT device 806, and the Negative DC input 807. A Backup Supply section 822 comprising a switcher-rated low-ESR capacitor element 810, acts as a low-latency high capacity energy reservoir to supplement the steady DC input 803, 807 terminals. A High Current IGBT Pre-driver comprising a Gate Input 805 and a IGBT Pre-Driver 852 provides a trigger to the gate terminal of an IGBT device 806. The Anode-Cathode Discharge section is comprised of the IGBT high speed power switch 806, which controls the discharge cycle of inductor 801 to the PPU Anode Terminal 850 which is connected to Thruster Anode 803 via connection 504. The return lead of the Thruster is Thruster Cathode 804, connected via Ground 861 to PPU Cathode Terminal 851. The external trigger pulse 501 is processed by the Gate Input 805 before triggering the high current pre-driver 852. A ground connection 861 connects the Negative DC input 807, Backup Supply Capacitor 810, the E terminal of the IGBT device 806. The equivalent resistance 802 is shown in FIG. 2 to indicate the initial resistance provided by the thin insulated layer between the Thruster Anode 803 and the Thruster consumable Cathode 804 terminals (typically 1-10 KW), which is described in full detail in the Keidar, Krishnan and Schein patents, which are hereby incorporated by reference. The arc discharge from the terminals 850 and 851 are routed through wiring connection 504, and returned through the common ground 861 completing the circuit. A radial magnetic coil 890 is present at a distance away from the Anode-Cathode Discharge section to accelerate the impulse-bit plasma flow 550 away from the Thruster Head.

It is necessary to understand the low-level behavior of the components of PPU 502 in order to determine whether it is possible to implement any method of fine control over the overall timing process which controls the generation of impulse-bits. The behavior can be described with the aid of basic electrical theory and the state flow diagram presented in FIG. 3 where there are a total of six states: Quiescent State 750, Initial State 752, Charging State 754, Breakdown State 756, Plasma Flow/Discharging State 758 and Discharged State 760, described below.

Figure 3:
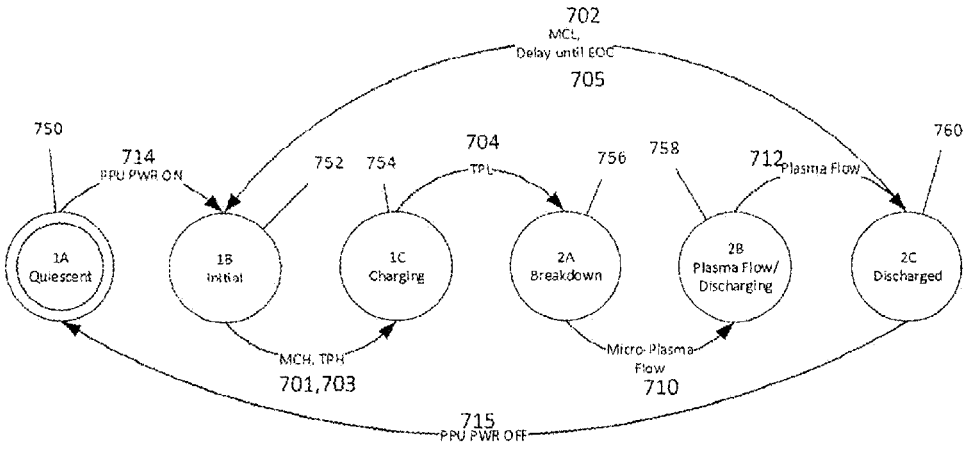
FIG. 3 is a state flow diagram showing dependent low-level steps required to generate impulse-bits.

With reference to FIG. 2, FIG. 3, n the Quiescent state 750, assuming a battery 808 (of voltage V between 18-25 Volts), with a grounded terminal 807 that is connected to system ground 861, is connected for the first time into the circuit via switch 809, the PPU is switched on 714 and current flows into the Backup Supply Capacitor 810 which has an internal resistance $R_c$ ohms and a Capacitance C farads and the system enters the initial state 752.

With reference to FIG. 2 and FIG. 3, in the initial state 752, the capacitor 810 reaches peak charge in about $5\times R_cC$ seconds time period with a charging profile of $$V(t) = V\left(1 - e^{-\frac{t}{R_cC}}\right)$$

and has the natural characteristic of discharging with a profile of $$V(t) = V\left(e^{\frac{t}{R_cC}}\right).$$

Figure 4:
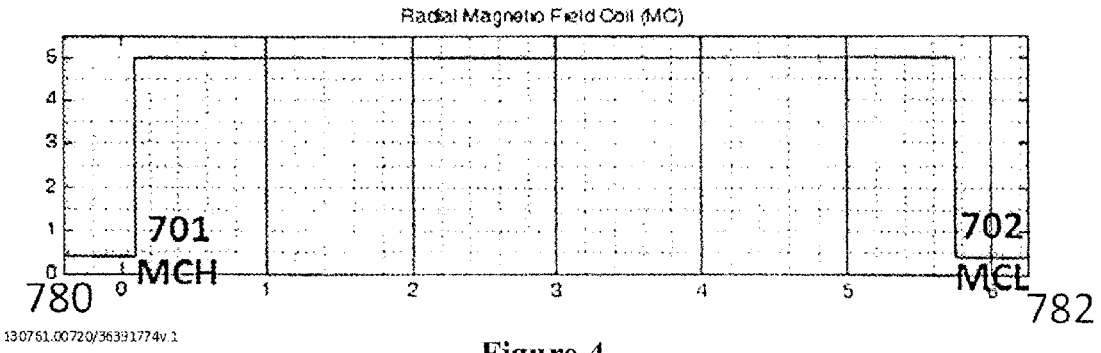
FIG. 4 is a plot of the low-level signal to control the magnetic coil, with time on the X-axis.
Figure 5:
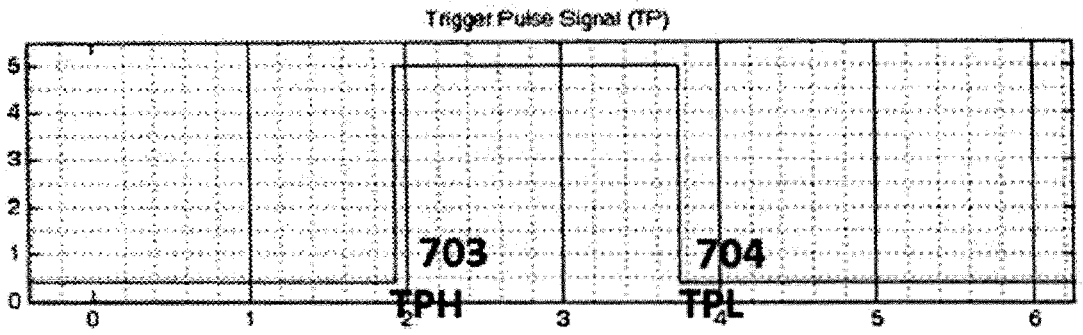
FIG. 5 is a plot of the low-level signal to control the driver trigger pulse, with time on the X-axis, at the same scale as FIG. 4.

During this Initial state 752 it is necessary to ensure that the MOFSET/IGBT device 806 be in the inactive condition, that is there should be no current flowing through the device from inductive element 801 to ground connection 861. Consequently inductive element 801, part of the Inductive Energy Storage 801 is empty of any magnetic energy, as there is no current flowing through its terminals. During this time, per FIG. 4, from the time mark 780 to time mark coincidental with event MCH 701 of FIG. 5, there is no production of any sort of energy from PPU Anode Terminal 850 to the Thruster Anode 803, via wiring 504. This Initial state 752 can be maintained indefinitely until it is decided to charge the PPU system at which point the magnetic coil is energized via the production of a Magnetic Coil High signal 701 followed by a very short time (typically tens of μS) later by a driver trigger 805 signal at time coincidental with event Driver trigger pulse High 703 to the IGBT device 806, at which point the system is in Charging state 754. The time different between Magnetic Coil High 701 signal and Driver trigger pulse High 703 signal is left to the designer for optimal energy management.

With reference to FIG. 2, FIG. 3, in the Charging state 754, the MOSFET/IGBT switch 806 is closed which performs as a 'clamped inductive switch' causing current to flow rapidly through the inductive element 801, having inductance L henries and Resistance $R_l$ ohms values, towards the ground connection 861. At this instant, no energy is produced from PPU Anode Terminal 850 to the Thruster Anode 803. The inductor 801 receives energy flow from the discharge profile of the Backup Supply Capacitor 810, as well as from the battery 808, and begins to store magnetic energy in accordance with the current flow rate of change. Given the natural properties of an inductor, the current through the inductor 801 reaches 99.5% of maximum after $5\times L/R_l$ seconds time period with the maximum current being defined as $I=V/R_l$, where V is the supply voltage from battery 808 and Backup Supply Capacitor 810, whichever is larger. During this time, magnetic energy is being stored in the same time period, so when the current flows lowest, the magnetic energy stored is at its highest value (due to back EMF created by the change in current flow through the inductor 801). After $5\times L/R_l$ seconds, the inductor 801 is at peak capacity, any further operation in this Charging state 754 can be considered wasteful of energy input and a risk of overheating device 806.

With regard to FIG. 2 and FIG. 3, from the end of Charging State 754, in the PPU activation process, events will happen in a continuous manner. From any time after the inductor inductor 801 reaches peak capacity, if the gate trigger 805 is disabled then the IGBT device 806 will be released from its "clamped inductive switch" mode of operation that has been energizing inductive element 801 and the system is then placed at the beginning of the Breakdown state 756.

In Breakdown State 756, the immediate discharge, with reverse polarity, of the stored magnetic energy from inductive element 801 entirely through the PPU Anode terminal 850 is rapid, and very noisy in RF spectrum output across a wide bandwidth, which can be used as a indicator that Breakdown has begun. Once the instantaneous brief spike of a high voltage discharge equal to $$L\frac{dI}{dt}$$

has reached breakdown potential, flowing from the inductive energy storage 801 to PPU Anode terminal 850, micro-plasma 710 begins to flow and the system progresses to the Plasma Flow/Discharging state 711. Micro-plasma emanates from the cathode spot across the insulator towards the anode terminal 803.

In the Flow/Discharging state 711, the current flow 812 establishes a high current (typically 50 A or greater) conductive circuit across the thruster anode electrode gap to allow fully discharge the remaining stored magnetic energy from inductive element 801.

The plasma arc current between the anode-cathode terminals 803, 804 rapidly decreases, at a steady voltage producing a region of intense energy. This energy current flowing between cathode to anode, vaporizes, consuming and ionizing cathode terminal 804 physical material, and the resultant ionized flow exits the thruster anode-cathode discharge region as hot plasma and is further accelerated by the application of the magnetic field produced by the Radial Magnetic Field of the Electromagnet 890 of FIG. 2. The electromagnet is typically kept energized until the Magnetic Coil Low 703 time mark is reached, which includes the Discharged state 760, representing a condition where no significant output is seen from the inductive element 801. At this stage, the PPU can be left discharged until the next cycle, which is marked with a delay until the End of Cycle 705 time event, after which the PPU operation can revert back to Initial state 707 and repeat, or return to Quiescent condition 750 if the PPU is powered off 715 via PPU Power Switch 809. For a operation in which a continuous flow of impulse-bits is required, the state flow diagram should be followed in the sequence, controlled by PPU Power On 714 and PPU Power Off 715 signal: 752>754>756>758>760>Variable EOC 705>752 . . . .

As the inductor is fully charged at the end of Charging State 754, it has a lot of energy that will have to be dissipated safely in an electrical circuit, when TPL 704 event time mark is reached. The follow-on arc discharge process cannot/should not be interrupted after the beginning of Breakdown state 709 to Discharge state 713, but the timing of this key event can be controlled by the scheduling of the driver Trigger Pulse Low signal 704. If the output time of the thruster head has to be adjusted, then the input time is a suitable control variable. Fine adjustment (fractional cycle adjustment)/Coarse adjustment (whole cycle adjustment) is possible at the Discharged state 760 or at the Initial state 752. But the timing of State 709 to 713 depends upon mostly the values of inductive element 801 and capacitor element 810, resistance 802 and the behavior of all physical components over time, and also the physical resistance characteristics of the anode-cathode insulated region. These are not able to be controlled through the lifetime of the thruster channel. In addition, as the thruster cathode element is consumed, so will the PPU discharge profile change, in minute quantities, as the terminal itself is the conductor, and the propellant, consuming itself. So the overall performance of production of impulse-bits is likely to change over time, and if fine control is to be maintained, there needs to be a method to adjust the driver trigger pulse scheduling within a small fraction of the full cycle, as the system components age, or requirements to schedule thruster operation change for mission needs.

However in all respects, the timing of the required driver trigger pulse has to be maintained so that the backup supply capacitor 810, and the inductive energy storage 801 are able to store enough energy per their respective time-constants of charging, and can be relied upon to provide the expected arc discharge current in a precise time frame. If such a time frame is unable to be achieved, the PPU may be discharging too frequently (low output, increased input), or too slowly (decreased input, excessive energy discharge) that is not conducive to efficient plasma production.

Figure 7:
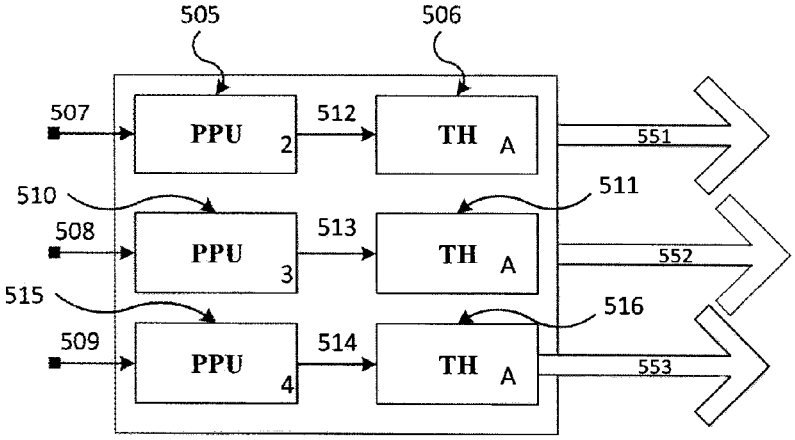
FIG. 7 is a block diagram of an array of Thrusters Channels, each with a single Thruster Head.

In FIG. 7, a plural set of vacuum arc Thruster Chains in an array configuration is presented, representing a common form of small spacecraft micropropulsion that is expected to be utilized in many space missions Based upon the discussion above on fine timing control and fine control over which thruster head is chosen to fire, and what impulse-bit accuracy goals are desired, it may become necessary to consider a situation where these chains have utilized together. In this example, there are three thruster channels, each with their own PPU 505, 510, 515 providing pulse energy to individual Thruster Heads 506, 511, 516. Realistic systems may have many such individual channels. While each channel would have it own independent driver trigger signal 507, 508, 509, it may be needed to schedule the firing sequence in such a manner that the composite impulse-bit output 551, 552, 553 of the array is in a timing window 610, shown simply in FIG.

Figure 11:
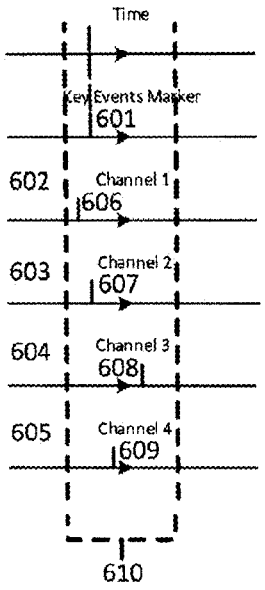
FIG. 11 is a portrayal of events for a small set of thrusters before any adjustment of driver trigger pulses.

10 as a line representing a brief block of time. This timing window 610 is calculated to accommodate the need to activate Thruster Heads 310-317 in order to turn the spacecraft to target region 373 of FIG. 14. It is possible that due to all of the above cautionary reasons, or any unexplained phenomenon, actual impulse-bit events could become skewed in time, as shown in FIG. 11, as such: 602 event could happen slightly before scheduled 601 key event as 606; 603 would happen at a time 607 which is almost equal to the desired key event 601, but not exactly; 604 might be heavily delayed for some reason to event 608; 605 could be observed to be slightly delayed to 609 position in time. This type of behavior is difficult to characterize in advance, but can be determined through correlation of performance related data, in mission control, or a dynamics analysis, with other onboard sensors. In fact, it is advisable to assume a timing window 610 exists in which key events may be scheduled to happen, but are not guaranteed to be in sync unless otherwise specified somehow. The possibility of 606 event happening is rare, and is set out to inform the user that if there exists an electrical circuit problem, and most of the other events happen later than expected (e.g., a delayed 601), it may appear that the lone event 602 happened before it was scheduled. FIG. 11 is the more realistic view of time based events of a vacuum arc thruster operating in space given the chance for variation of hardware configuration, software issues, propagation issues, component value change, or perhaps variations due to uneven erosion of cathode element 804, or uneven performance of the insulator path minor resistance 802 which is tied intimately to the discharge timing characteristics of elements 801, 810 and variable switching times of 806 in response to the applied driver trigger pulse at gate 805 of PPU presented in FIG. 15.

Figure 8:
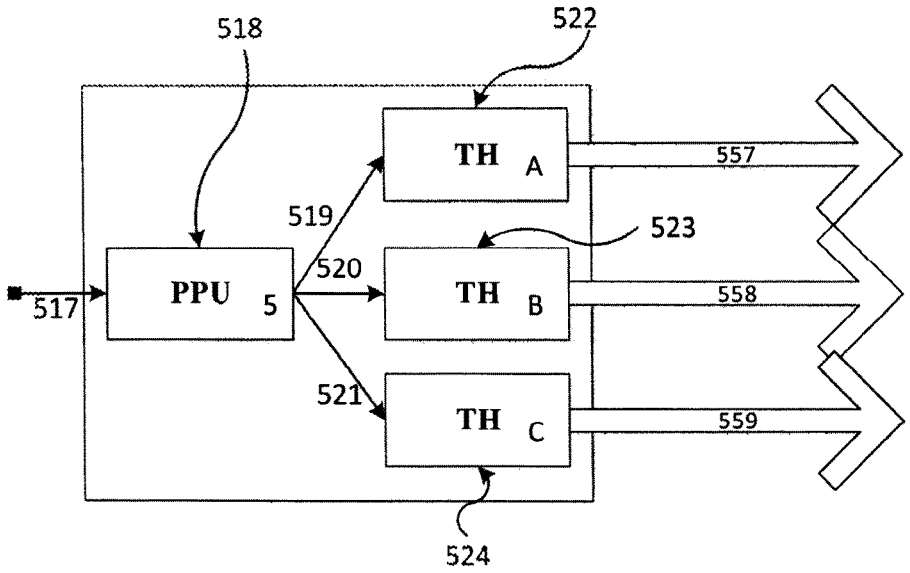
FIG. 8 shows a Thruster Channel, with a cluster of Thruster Heads.
Figure 12:
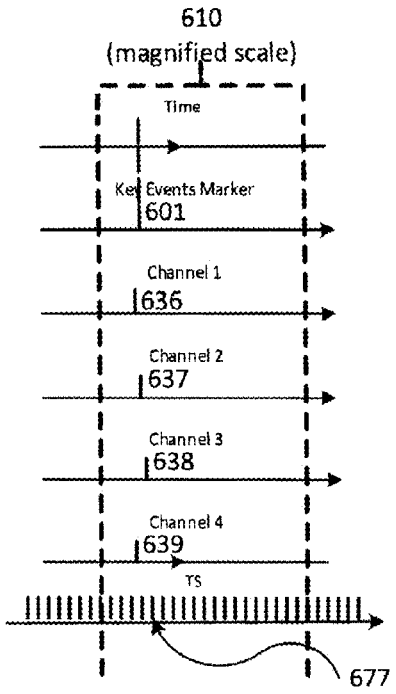
FIG. 12 is a portrayal of events for a small set of thruster after fine adjustment of driver trigger pulses.

In FIG. 8, a different example is presented, where a single PPU 518, in a cluster arrangement, is used in a very high capacity/operating frequency (repetition rate) mode, with the proviso that is has been designed to provide sufficient power for several thruster heads 522, 523, 524 combined. This may be done to reduce the mass and volume specifications for a PPU, by creating a more efficient circuit, or utilizing a different type of technology (e.g., potentially a supercapacitor instead of an inductive element) that produces larger energy discharges than a convention inductive element based PPU. The exact numbers/specification for such a PPU are not important in this invention as the focus is timing for this architecture, involving 1-to-many connections for a PPU to serve several Thruster Heads 522-524. Here, delays or variations can occur due to differing path lengths from the PPU 518 to the switched Thruster Heads 522-524 on an individual basis, and the complex behavior of single driver trigger pulse 517 being used to generate a higher frequency PPU output, which is then switched repeatedly to the appropriate thruster head. There is no relation between the architecture of FIG. 7 and FIG. 8, only mission driven design decisions such as: combining many thruster elements to develop greater thrust levels in an impulse-bit, having redundant elements in a cluster, allowing for selective utilization of a thruster element from a cluster to ensure uniform consumption, etc. In this example, as the PPU 518 is generating different pulse sequences to the various Thruster Heads 522, 523, 524, the fine adjustment of the driver trigger pulses 519, 520, 521 would be absolutely vital to ensure that all the impulse-bits 557, 558, 559 events are generated not at time marks 606, 607, 608, 609 of FIG. 11, but at time marks 636, 637, 638, 639 respectively of FIG. 12.

Figure 9:
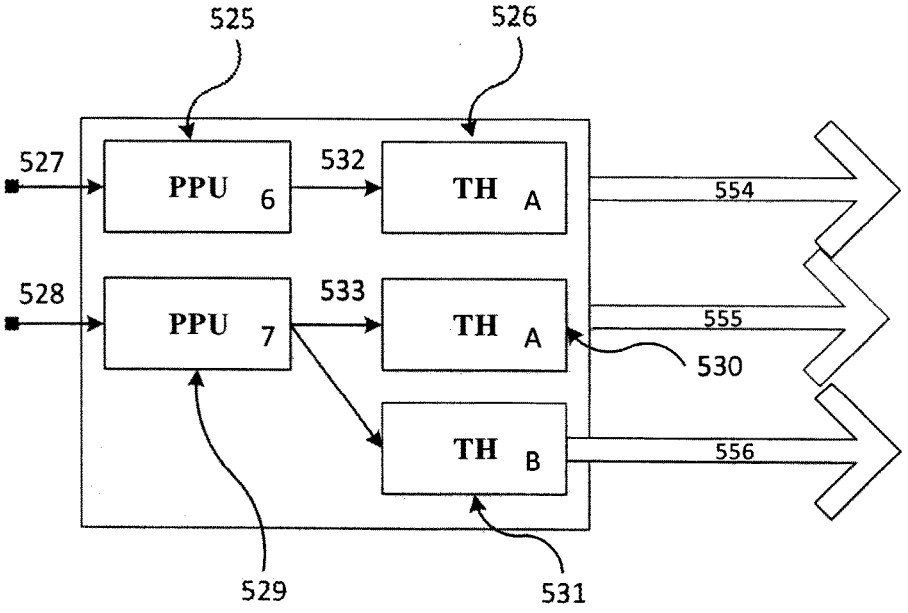
FIG. 9 shows a hybrid arrangement of two Thruster Channels.
Figure 10:
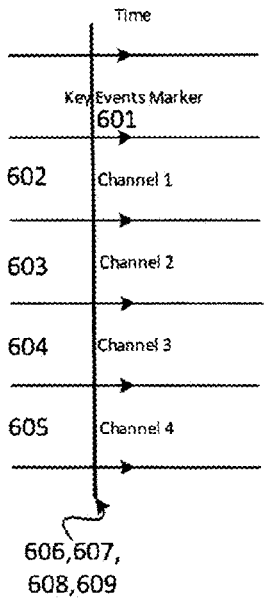
FIG. 10 is a diagram showing theoretical events for a small set of thrusters.

In a combined example of two PPUs and three Thruster Heads, is shown in FIG. 9. One thruster channel comprises PPU 525 and Thruster Head 526 having to be used in tandem with another Thruster Channel comprising PPU 529 serving Thruster Heads 533 and 531 in a clustered arrangement. Fine timing control would be absolutely vital to achieve proper operation of this system, which may be necessary if a sufficient control authority from a single set of Thruster Heads were deemed insufficient for a mission objective. This sort of scenario may be expected to arise in a scenario that utilizes a spacecraft with redundant rings of Thruster Heads and PPU, being switched into service as desired by the mission planners, accounting for long duration use and possibility of failure modes where certain elements have to be taken off-line.

In light of the above analysis of the theory of operation of PPU and Thruster Heads, there are numerous reasons why a simple actuation of the concerned thruster element(s) of a Vacuum Arc Thruster (and derivatives), cannot be relied upon for producing the exact forces/torque or forces/delta-V effect desired. The exact mass and mass distribution of the concerned system (e.g. Spacecraft 301 of FIG. 14) at the beginning of the impulse-bit actuation process cannot be precisely measured. Hence all subsequent mass dependent calculations (e.g., Attitude control, delta-V) are a calculated value with error margins. In addition, in vacuum arc thruster science, the low-level cathode spot production process is non-linear and dependent upon physical/electrical magnetic parameters, not under the control of the mission designers. Subtle variations in physical geometry of the thrusters from manufacturing specifications over the lifetime of the thruster, may also hinder accurate calculations. Therefore the amount of thrust/force/torque that can be produced during a single impulse-bit event is also a calculated value. A spacecraft is always in motion, and always on a complex trajectory path, which is susceptible to disturbance torques due to external space environment, so additional propulsion corrective maneuvers are very common after a series of actuation of thrusters.

The exact location of the centroid of the mass 304 (FIG. 14) at the beginning of the actuation process cannot usually be measured, in the midst of an ongoing mission, as mass/volume/thermal/density properties of the spacecraft may have changed in flight, and some amount of the consumable propellant may have been consumed in prior operations, and deployable components may have adjusted positions in flight. Thus, the inertia can be estimated but not accurately predicted. Again corrections are typically needed after a major actuation of the thrusters.

When any such electrical thruster system is actuated, the force imparted on the spacecraft is not linear, is dynamic, and is variable in very small units, due primarily to the chaotic processes involved in the arc triggering/joule heating and cathode spot production process, and is also highly dependent upon the energy flowing into the anode-cathode discharge region.

Every thruster head is provided energy from a PPU, a power conversion device that takes steady/variable DC/AC and produces large current, low/medium voltages, at microsecond scales. The precise energy input for a single impulse-bit event, is dependent upon the pseudo-repetitive output behavior of the thrusters associated PPU which itself known to be dependent upon the instant values of the various analog components involved in its operation which include significant components dependent upon environmental characteristics and operational states, including its own behavior over time—that is, there is no guarantee that each and every pulse will be in synchronization with the intended firing pattern, and will be expected to have some very small variations in timing that may be not visible to a casual observer, but should be detectable using precision measuring systems.

Vacuum arc thruster derivative electric propulsion systems are essentially either quasi-steady, mostly-on, mostly-off, or repetitively pulsed operation devices, and rarely are they usually operated on constantly-on basis. Their phase wise low-level actuation events are also not in one continuous sequence, and operations are always on-demand. It is quite likely there will be distinct time gaps between actuation, depending upon the dynamics control modes and requirements. Therefore for every new actuation event (i.e., a particular impulse-bit operation), the startup conditions of the system is bound to be different than the previous actuation event, and in any case, due to the fact that some thrusters utilize their own cathode terminals as propulsion material that has to be eroded (unlike a chemical propulsion system where the tanks with propulsion material does not influence the rocket motors operation), the start-to-finish behavior of a such an electric propulsion system is highly dependent upon all of the devices previous operation and utilization factors.

If a propulsion element, or a thruster head, is moved from its initial position by an external actuator, which is connected to its energy source through a variable contact (e.g., sliding contact) or perhaps disconnected and reconnected from its primary contact to an alternative pathway due to in-situ reorganization under operational control (e.g., a primary pathway has failed, backup pathway is utilized) or a portion of the element is reloaded (with new propulsive material store), then the timing of the chain may not be the same as before to minute degree.

Closed loop control for specific propulsive maneuvers is often employed by propulsion system designers, who attempt to account for the granularity of thrust/force produced by a sequence of pseudo-similar pulses, by controlling the pulse trains (on/off) of different thrusters and employing other devices/actuators for imparting corrective measures (e.g., reaction wheels, magnatorquers, commanding canting of external mechanisms to impart pressure on the spacecraft, actuating opposing thrusters, asymmetric thrusting etc.). While there exists a different possibility to manage the timing of the driver trigger pulse that would initiate a thruster impulse-bit event, this method requires some sensor feedback from a portion of the anode-cathode discharge circuit to allow a controller to adjust the pulse start, duration and issue any correction for errors found off nominal specifications of the pulse train.

As a pulsed electric propulsion system is scaled up/down or adapted to accommodate different spacecraft functions, and to accommodate redundancy expectations of the system (e.g., if a portion of the system is non-functional, can the mission objectives still be maintained, and how) the firing of individual thruster channels becomes a small part of problem, and is replaced by a bigger problem, how to ensure that the concerned thruster PPU are utilized in a controlled manner, and what would need to happen that they can still be utilized if any of their fundamental properties (that influence the timing) have changed over the lifetime.

The subject of the present invention focuses on improving the accuracy of the trigger process of a pulsed thruster. In realistic units, the scale of fine-tuning may be expressed in minuscule terms of force (In FIG. 14, adjustment of the thruster impulse-bit products 340, 341, 342, 343, 344, 345, 346, 347, 348, 349, 350, 351 by micro-newtons or nano-newton amounts) or of more precise timing (adjustment of the on-pulse or off-pulse time of the impulse-bits (adjustment of the thruster impulse-bit products 340-351 to by micro-seconds or nano-seconds). This process is intended to be used in addition to the per-pulse digital pulse based coarse synchronization (on a milliseconds time scale) that is typically seen in spacecraft control circuits.

In light of the expected challenges in future space mission employing vacuum arc thrusters, the structure of a driver trigger pulse generation process can be enumerated in Table 1 as five low-level process steps, or events. Utilizing register level precision interrupt timers to generate a stable, and autonomous timebase from a microprocessor a new driver pulse generation control method has been investigated, and analyzed for the ability to fine tuning of driver pulse timing. The new method has been programmed in microprocessor hardware and used to operate a three channel, and a four channel Micro-Cathode Arc Thruster subsystem, and observed to have the properties of fine adjustment of driver triggers within a small fraction of a cyclical time period, in the manner described below.

TABLE 1

Key events of a single driver trigger pulse (low-level)
Example μCAT operational markers
(low-level events, in order of increasing time)

| FIG. 3 equivalence | Event | Event Marker (units: Time Slices) | Description |
|---|---|---|---|
| | Driver Pulse ON | | See Table 3, below |
| 701 | MCH | MCHC | Magnetic Coil Logic High |
| 703 | TPH | TPHC | Driver trigger pulse Logic High |
| 704 | TPL | TPLC | Driver trigger pulse Logic Low |
| 702 | MCL | MCLC | Magnetic Coil Logic Low |
| 705 | EOC | EOCC | End of Cycle |
| | Driver Pulse OFF | | See Table 3, below |

The present invention can utilize any suitable hardware timer feature, such as one found in most modern microprocessors. The timer can be implemented with a sufficiently capable stable clock circuit in conjunction with a low latency digital interface. An autonomous, repetitive, hardware based, low-level timing mark 677 (FIG. 12) may be referred as 'Time Slice', or TS, or in other domains, as a 'Timebase'. Once a TS 677 is calculated (see example below) and then generated by suitable hardware, firmware and real-time applications for the purposes of this invention, in can be treated as being an independent source of a clock pulse/counter pulse for timing triggers or events.

As it is likely that such a feature utilizes the on-chip clocks with user programmable dividers, prescalers and counters, it is useful to consider the benefit of such a programmable timer as an independent task running within the system constraints of an embedded real-time operating system application.

As an example, using a Motorola ColdFire V2 5270 microprocessor specification a value for Time Slice (TS) was calculated using the manufacturer's formula:

$$TS = \left(\frac{1}{CLOCKFREQ}\right) * \text{DIVIDER} * (PRESCALER + 1) * (REFVAL + 1)$$

where CLOCKFREQ is typically 73,728,000 Hz (half of the ultra stable internal system clock of about 147 MHz), DIVIDER is either 1 or 16, PRESCALER is a value between 1-256 inclusive, and REFVAL is a 32-bit reference compare value. In this particular example, the hardware timer originally intended for use as a Direct Memory Access (DMA) function is utilized, for which the value of REFVAL is fixed by the manufacturer, and it is seen in the microprocessor documentation that it is important to select a REFVAL so that other events can also be coordinated with the same time base. Different manufacturers of microprocessor hardware implement these features differently, so the above example is merely illustrative.

As a spacecraft is comprised of many other subsystems, and if it employs one or more PPU to drive vacuum arc thrusters in its propulsion subsystem, each activation cycle may affect adjacent system performance, including generating copious amounts of Electromagnetic Interference (EMI) that will have the possibility of affecting instrumentation and communications (e.g., it may affect the radio communication) badly. Therefore, system designers will in most probability require, and would principally benefit from, a low-level precisely synchronized signal for each event enumerated in Table 1, so that mission planners can have the option to turn off/turn on sensitive equipment such as: sensors, cameras, solar panel battery chargers, communication equipment etc. This is implemented in the present invention by issuing appropriate software "event signals" at each key event processing block via an interface 856 of FIG. 16. For this purpose, a suitable count table is constructed that allocates individual counts, in units of hardware timer values (TS or Time Slices), for the required MCH 701, TPH 703, TPL 704, MCL 702 of FIG. 5, and EOC 705 time marks, for each active thruster channel, and designated MCHC, TPHC, TPLC, MCLC, and EOCC values. These comprise the foundational time base for the previously presented operations of a PPU that is tasked with producing continuous flow of energy to thruster heads following the state flow diagram of FIG. 3.

These event signals would be one each for the five low-level events of a PPU: MCH 701 generated at TS count MCHC, TPH 703 generated at TS count TPHC, TPL 704 generated at TS count TPLC, MCL 702 generated at TS count MCLC and to denote the end of a impulse-bit cycle, EOC 705 generated at TS count EOCC.

Figure 13:
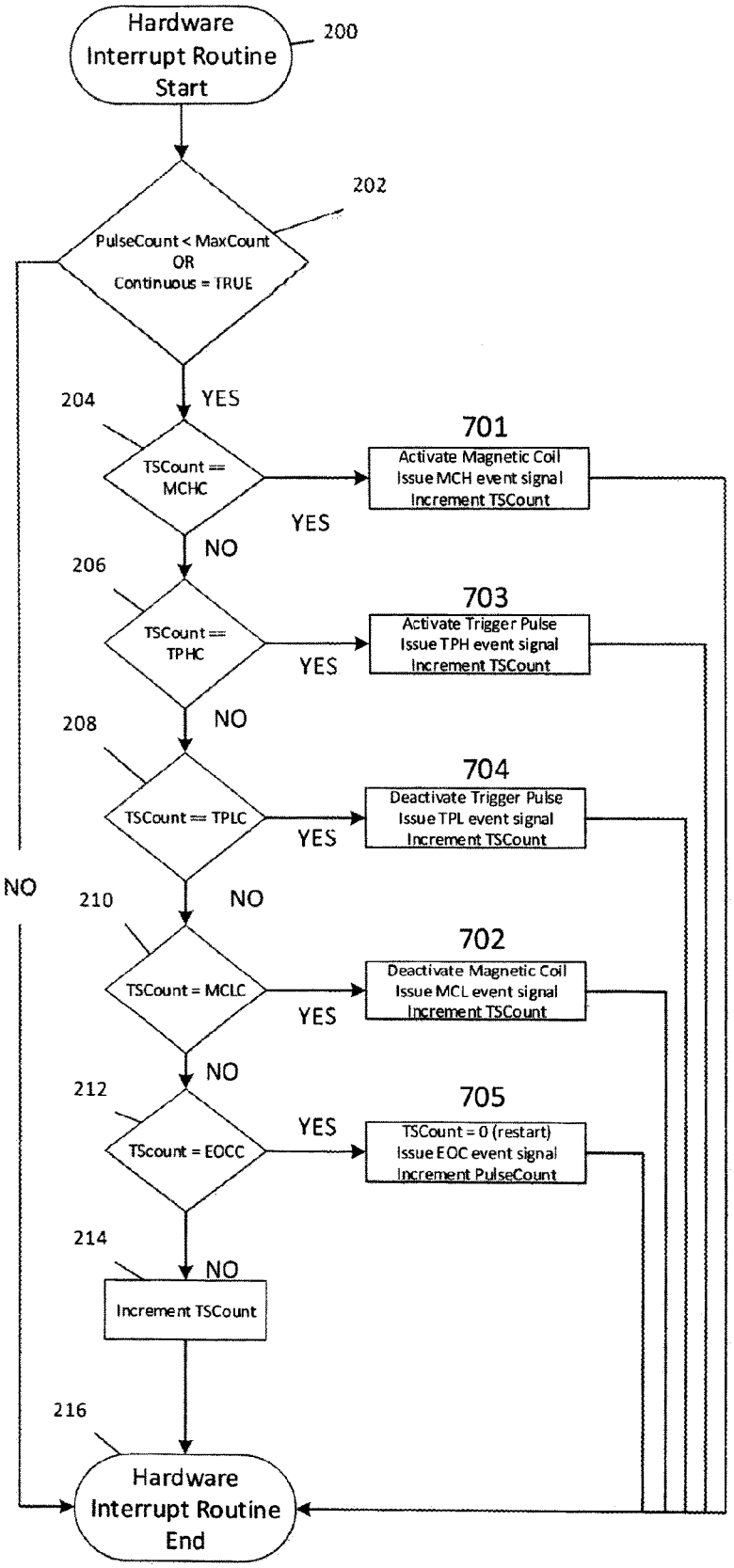
FIG. 13 is a flowchart of method for fine timing adjustment of trigger signals running as a real-time application in a real-time environment on a microprocessor.
Figure 16:
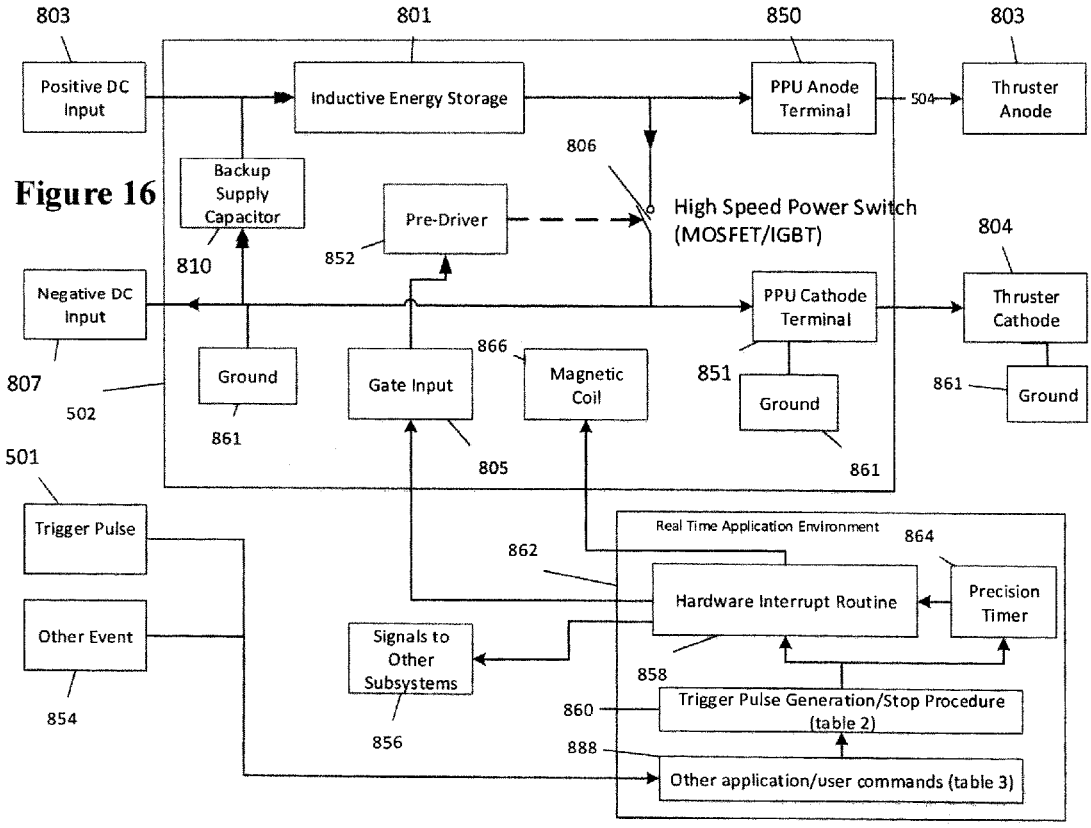
FIG. 16 is a block diagram of the sections of a generic PPU with coarse and fine control.

Pseudo code is presented in Table 2, accompanied by a flow chart in FIG. 13, with the key event processing blocks identified to match the operational states of FIG. 3. At the invocation of the hardware interrupt routine (a piece of software 200-216 and branches 701,703,704,702,705 that is executed by a microprocessor (i.e., processing device) every time a designated interrupt is generated on an event triggered by a precision timer in this invention), a multi-level conditional decision tree is utilized (the whole routine is a If-else-if-else-if-else-if-else . . . scheme), with the objective of implementing a very fast switching algorithm to implement fine control of PPU events, where a decision to take action is decided at the fastest possible opportunity. For each conditional branch, only a single check is performed and if it fails, the next branch is explored, incrementing TScount immediately at the native speed of the real-time processor, as this is all running in a real-time operating system application on a single CPU. The interrupt routine 858 of FIG. 16 is typically executed several hundred times a second, on an autonomous basis.

In Step 202 of FIG. 13, the value of a variable called PulseCount is compared with a stored variable called MaxCount to determine if the impulse-bit needs to be generated. If yes, the routine proceeds to next step. If no, the routine continues.

In step 204 of FIG. 13, a comparison is made between the value of TSCount and the first critical PPU event time value, MCHC which represent the MCH event 701 of FIG. 3. If yes, the magnetic coil 890 of FIG. 2 is activated and the routine exits, incrementing the TSCount by one value. If no, the routine continues. TheTScount increment for a single valid event aids in the sequencing of events at the nS-μS timescale with a distinct in-memory operation which can be monitored by other in-memory real-time applications if so desired.

In Step 206 of FIG. 13, the time value of TSCount is compared with the time value of TPHC, which represents the TPH event 703 of FIG. 3. If yes, the gate input 805 is provided a logic signal to implement a clamped inductive switch, causing inductor 801 to begin charging and the routine exits after increment TSCount by one. If no, the routine continues.

Steps 208, 210, 212 of FIG. 13, are of a similar nature as previous steps as 204, 206 and in these branches, the events Trigger Pulse Low 704, Magnetic Coil Low 702 and End of Cycle 705 are either activated, or deactivated depending up the match of the time value of TSCount with that of the low-level event marker which are TPL 704, MCL 702 and EOC 705, respectively. In all of the three steps, if a test fails, the process continues with the next step and if a test succeeds, the value of TSCount is incremented by one and the routine exists.

Any match, and the hardware interrupt routine ends immediately to allow the interrupt routine to be exited, and the overall system 858 of FIG. 16 can then prepare for invocation at the next cycle, that is generated numerous times between each of the time difference periods between MCHC, TPHC, TPLC, MCLC, EOCC events. With reference to Table 5, an example is given where such differences could as small as, or even smaller than: 1.8 mS (time between MCHC/TPHC), 1.8 mS (time between TPHC/TPLC), 5.6 mS (TPLC/MCLC) and a variable amount of time between MCLC/EOCC that is used to set the impulse-bit repetition rate. During these periods, the interrupt routine has been called several hundred times, which is shown in Table 5, as Counter Values.

The pseudo code is used to outline the nominal steps (Table 2, below) required to programmatically define an interrupt driven embedded control application that generates signals according to any set of MCHC, TPHC, TPLC, MCLC, EOCC values. The code is designed to be executed as a Real-Time application, in a Real-Time operating system on a dedicated microprocessor. In FIG. 16, different from FIG. 15 architecture by embedded real time application environment 862, the external trigger pulse 501 is routed to be handled in-memory of a microprocessor a dedicated procedure executed as an additional real time application 888. A Precision Timer 864, a component of said microprocessor, is set to generate high speed (typically, nS or μS cycle time) hardware interrupts to activate Hardware Interrupt Routine 858, which executes the low-level commands enumerated in Table 2. As the timer 864 produces rapidly cycling repeating low-level timing signals, dependent upon the values of TS defined earlier, an in-memory counter TSCount (calibrated in Time Slice units) is used to keep track of the actual real time mark. The behavior of the hardware interrupt routine is modified by realtime pseudo-code application 888 (enumerated in Table 4) responsible for handling other application/user commands and realtime pseudo-code application 860 (enumerated in Table 3) responsible for handling the Trigger Pulse generation and stop procedures. In Table 3 and Table 4, methods are shown to allow desired useful goal: of fine adjustment, for each distinct impulse-bit implementation. Through this method, the values of the MCH, TPH, TPL, MCL, EOC time slice (TS) counts can be programmed differently as frequently as needed.

While only a single driver trigger pulse implementation is presented Table 2 the algorithm strategy can be expanded to have extra conditional execution blocks and additional logic trees to compare the TSCount from any number of high frequency hardware based timer signals so that several thruster channels low-level event sets (each having MCHC, TPHC, TPLC, MCLC, EOCC) can be controlled with fine precision.

The real-time value of the definition of TSCount units can be modified in operation, by repeated application of pseudo-code programming steps in Table 3 by stopping a pulse train, resetting the parameters of events (MCHC, TPHC, TPLC, MCLC, EOCC) and restarting. This is in addition to any conventional delays that can be implemented in software, or other hardware features, providing system designers with extra ordinary control over the low-level timing of the key events.

Table 4 shows the nominal method for users to set a predetermined count of impulse-bits to be generated, or a method to enable/disable continuous generation of driver trigger pulses, with fine timing control between the invocation periods.

To demonstrate a fine timing control operating modes using this invention, an actual use-case is presented in Table 5. By adjusting the value of EOCC only to set the period repetition rate, and by defining reasonable values of the timing of MCH, TPH, TPL, MCL for each cycle, it is possible to trigger the driver to actuate a PPU at different operating frequencies, while ensuring that each low-level event can be adjusted to a fractional time of a cycle (each unit of TS: 10 μS) whereas the entire cycle is approximately 5.68 mS. The resultant minimum unit for fine adjustment of a driver trigger's low-level components (MCH, TPH, TPL, MCL) is then TS/Period, equal in this case to: 10 μS/5.68 mS=of 0.18% of a cycle, for each cycle. Both TS units and real time values of the key events of this example are enumerated in Table 5, for comparison.

TABLE 2

{Embedded Real Time OS: Hardware Interrupt Routine Definition}

```
if ((PulseCount < MaxCount) || (Continuous == TRUE)) {
  if (TSCount == MCHC) {
    //activate magnetic coil, issue MCH event 701 and read sensor inputs
   TSCount++;
  } else {
   if (TSCount == TPHC) {
    //activate driver trigger pulse issue IPH event 703 and read sensor
    inputs
    TSCount++;
   } else {
    {
     if (TSCount == TPLC) {
      //deactivate driver trigger pulse issue TPL event 704 and read
      sensor
inputs          TSCount++;
     } else {
      if (TSCount == MCLC) {
       // deactivate magnetic coil and issue MCL event 702 and read
       sensor inputs
       TSCount++;
      } else {
       if (TSCount == EOCC) {
                        // end cycle after delay and issue EOC event 705
```

TABLE 2-continued

{Embedded Real Time OS: Hardware Interrupt Routine Definition}

```
and read sensor inputs
          TSCount = 0; //restart
          PulseCount++;
         } else
         TSCount++; //go to next cycle
        } // EOCC case
       } // MCLC case
      } // TPLC case
     }
    }
   }
  }
```

TABLE 3

{Embedded Real Time OS: Driver trigger pulse generation and stop procedure 860}

1. TSCount = 0;
2. Define: Clock Source, Divider, Prescaler,
3. Define: Interrupt Vector to Interrupt Application
4. Enable the Timer function
5. Operate normally ...
6. Stop the Timer function

TABLE 4

{Embedded Real Time OS: other application/user commands 888}

1. For pulse generation upto a certain pulse count {SET PulseCount = <some positive numeric value>}
2. To enable continuous driver trigger pulse generation {SET Continuous = TRUE} anytime
3. To disable continuous driver trigger pulse generation {Set Continuous = FALSE} anytime

TABLE 5

{MOD5270/NETBURNER SB70LC) DMA Timer Calc V2 for MTCUPCB2}
[SINGLE SHOT PULSE]

Active Time (ta): 0.0056504
Events (inclusive of rise/fall times):
MCH 0 mS
TPH 1.8208 mS
TPL 3.6416 mS
MCL 5.6424 mS
[CONTINUOUS OPERATION]
Full Cycles: 176
Partial Cycles: 0.978621
Idle Time per period (td): 0.0314182 mS
Active Time, per period (ta): 0.0056504
Events (inclusive of rise/fall times):
MCH 0 mS
TPH 1.8208 mS
TPL 3.6416 mS
MCL 5.6424 mS
EOC 5.68182 mS
Checking Total time period for 176 full cycles is: 1 seconds
[MCF5270 DMA TIMER and Interrupt Count Values]
Time Step (TSR): 10 uS
REFVAL: 367
DIVIDER:1
PRESCALER:1
Counter Values (TPHC, TPLC, MCLC, EOCC) in ascending order of time

| | |
|---|---|
| 0.0018208 | 182 |
| 0.0036416 | 364 |
| 0.0056424 | 564 |
| 0.00568181818181818 | 568 |

TABLE 5-continued

| {MOD5270/NETBURNER SB70LC) DMA Timer Calc V2 for MTCUPCB2} [SINGLE SHOT PULSE] | |
|---|---|
| 1 | 99434 |
| 2 | 49434 |
| 3 | 32768 |
| 4 | 24434 |

Figure 17:
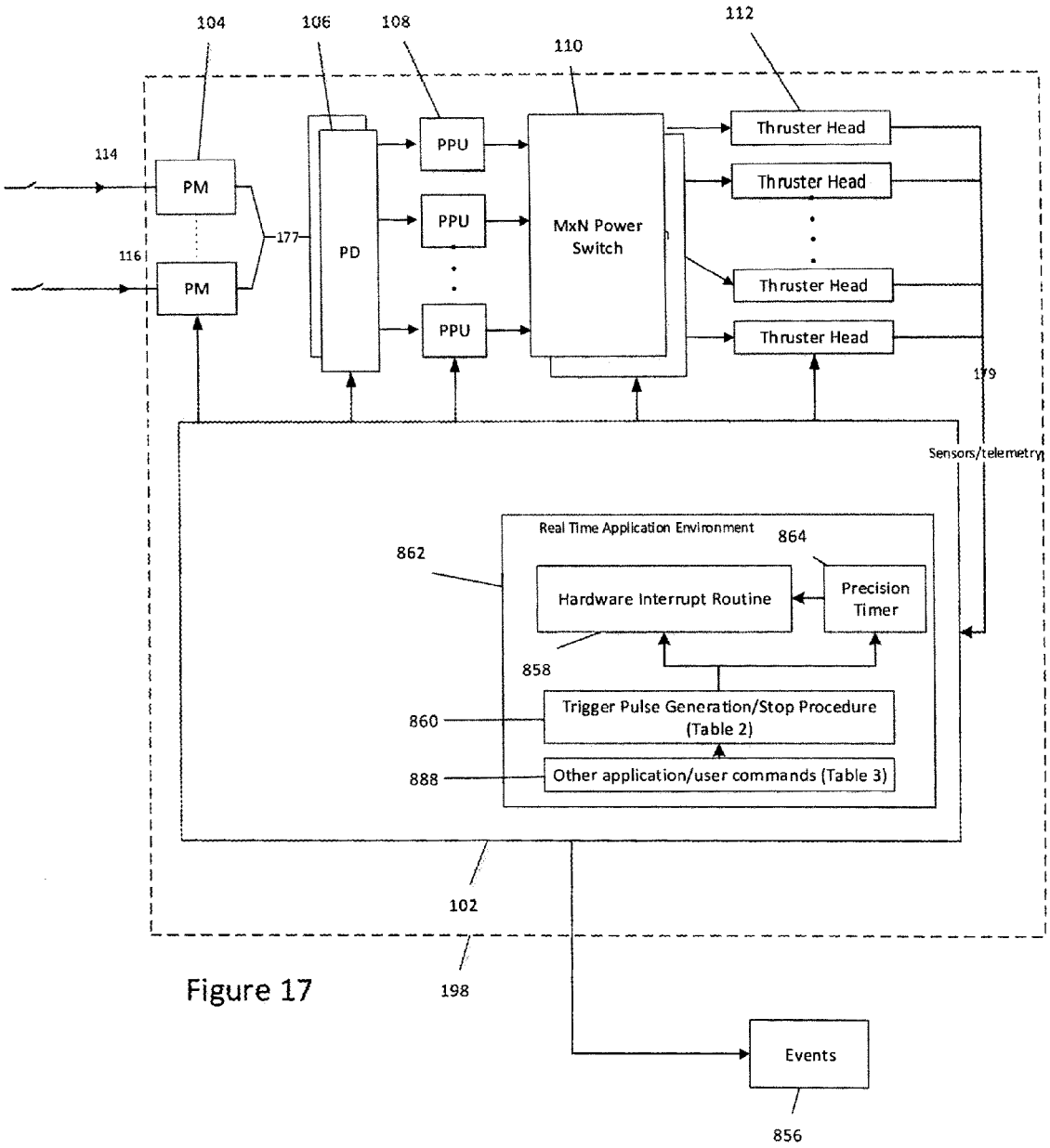
FIG. 17 is a block diagram of a micropropulsion system.

In FIG. 17, the embedded realtime application environment 862 of FIG. 16, is embedded in a hardware 'control unit' 102 (e.g., a processing device) mostly comprised of a dedicated microprocessor with logic and hardware to manipulate components necessary for pulsed plasma thruster (e.g., FIG. 2, FIG. 15, FIG. 16 or similar), and is tightly and integrated into design flow of vacuum arc thrusters and derivatives, in order to fabricate a fault tolerant pulsed plasma thruster apparatus 198. Power supplies 114, 116 serve as redundant input to the Power Management modules 104. The regulated power output 177 combines both power rails and serves as input to a redundant bank of power distribution devices 106, which feed the redundant bank of PPU 108. The output of the PPU 108 banks are switched at will to the appropriate Thruster Head 112 which can be distributed according to workload of the mission. The control unit 102 contains the microprocessor based hardware to provide the proper execution environment, and precision interrupt timers required for environment 862. The pulsed plasma system 198 can now function with very fine timing precision (typically in the nS range) and has a new capability/opportunity to be fed with sensor/telemetry 179 data from active thruster heads 112 for exact system status monitoring, at nS time scales, to be processed by the control unit 102. Should any low-level event need to be communicated with another subsystem onboard the spacecraft (as outlined above), the control unit 102 can send status messages via the events 856 on a real time basis.

The function of magnetic coil (890 of FIG. 2, 866 of FIG. 16) can now be controlled in a flexible manner, as the timing of the activation of this signal can be made at will by control unit 102, including turning on the magnetic coil 890 for one impulse-bit, and re-energizing for another, or turning off 890 for one cycle, adjusting the power level (and resulting magnetic field) and then resuming activation of 890, allowing variable levels of thrust to be easily produced in the same thruster.

The system can include a processing device 102 (FIG. 17) to perform various functions and operations in accordance with the invention. The processing device can be, for instance, a computer, server or mainframe computer, or more generally a computing device, processor, application specific integrated circuits (ASIC), or controller. The processing device can be provided with one or more of a wide variety of components or subsystems including, for example, a co-processor, register, data processing devices and subsystems, wired or wireless communication links, input devices (such as touch screen, keyboard, mouse) for user control or input, remote or local monitors for displaying information to the user, and/or storage device(s) such as memory, RAM, ROM, analog or digital memory, flash drive, database, computer-readable media, floppy drives/disks, and/or hard drive/disks. All or parts of the system, processes, and/or data utilized in the invention can be stored on or read from the storage device(s). The storage device(s) can have stored thereon machine executable instructions for performing the processes of the invention. The processing device can execute software that can be stored on the storage device. The invention can also be implemented by or on a non-transitory computer readable medium, such as any tangible medium that can store, encode or carry non-transitory instructions for execution by the computer and cause the computer to perform any one or more of the operations of the invention described herein, or that is capable of storing, encoding, or carrying data structures utilized by or associated with instructions.

The processing device can also be connected to the Internet, or other compatible data network, such as by a wireless card or Ethernet card. The processing device can interact with a website to execute the operation of the invention, such as to present output, reports and other information to a user via a user display, solicit user feedback via a user input device, and/or receive input from a user via the user input device. For instance, the processing device can be part of a mobile smart phone running an application that communicates with the user and/or third parties via the Internet, and in an embodiment of this invention has been tested in a PhoneSat spacecraft bus, whereas a portion of the processing of 862 (FIG. 17) was executed in a smartphone functioning as a central processing unit.

Accordingly, the invention includes a system and method defining the low-level stages of operation of a plasma power unit of a pulsed plasma thruster system. These stages are (a) Quiscent State (b) Initial State (c) Charging State (d) Breakdown State (e) Plasma Flow/Discharging State (f) Discharged State. The system and method define the low-level stages of a driver trigger pulse generation process, where independent event markers are set in time-units to control Trigger Pulse activation/deactivation, Magnetic Coil activation/deactivation, End of Cycle signal, and other spacecraft related event markers that could be defined for activation at different timing marks. The system and method invoke a hardware based precision timer as a low-level, autonomous timebase for the purposes of repeatedly invoking a hardware interrupt timer containing code to generate a time-slice counter value. The system and method include an algorithm that can be used to determine, when invoked, a rapid match between a time-slice counter generated by a hardware interrupt timer, and a preset value for any number of event markers such as the said event markers. The steps to rapidly match the current time-slice counter and a stored value is in the form of a nested conditional branch chain: IF . . . ; THEN . . . ; ELSE . . . ; IF . . . ; THEN . . . ; ELSE . . . ; IF . . . ; END; END; END. Each step is modifiable to execute only those commands of a pulsed plasma thruster system appropriate for that single instance of a time-slice counter/event marker match, and nothing else. Each succeeding call to the same routine of the repeating hardware interrupt timer will advance the time-slice counter but the same event will not be matched in the period of a single cycle. The system and method include a programmable control unit employing a realtime application environment to implement the algorithm.

In addition a system and method are provided to use the control unit to produce fractional impulse-bits. The driver pulses necessary for initiating the charging/discharge process of a plasma power unit can be manipulated to stop/start as needed. The control unit control signals to activate electromagnets which can be turned off (causing low acceleration) and turned on (causing high acceleration) of plasma from a thruster, and this process can be manipulated at a very low-level with the control unit, with high degree of precision. Therefore the impulse-bit production can be manipulated within each operation cycle.

The driver pulses to enable the charging/discharging process can be intentionally changed during pulsed operation by the control unit, allowing different pulse on-times and off-times that would be designed to affect the flow of arc discharge current between the plasma thruster terminals.

A system and method are also provided to change the low-level components of the impulse-bit timing chain on demand to suite mission needs. The operation of a driver trigger pulse can be stopped, reprogrammed and restarted within the span of a single impulse-bit timing cycle. This is a flexibility that allows operational mode changes at will of a multi-channel pulsed plasma thruster system. A control unit contains a real time application environment that can be updated with programming to control with precision, at a very low-level, all functionality of a multi-channel scalable electric propulsion system. The system and method adjusts the low-level timing functions of PPU to account for system behavioral changes over time, and mission needs.

A system and method are also provided to route energy from banks of PPU to many thrusters, using a control unit as an integrated part for simultaneous redundancy and fine timing control and also to communicate such low-level events to other spacecraft subsystems that need situational awareness of the system states. A subsystem in which numerous redundant sections, controlled by the control unit, can form a highly flexible scalable micropropulsion subsystem. The system and method communicate low-level events from the subsystem to other spacecraft subsystems at very high frequencies (nanoseconds to microseconds, i.e., at wire speeds). An architecture for an ASIC or FPGA implementation of a control unit combined with numerous PPU modules, and M×N Power switches for a tightly integrated fault tolerant multi-channel pulsed plasma thruster propulsion module. This overall architecture may be used in other fields, indirectly related to space propulsion, in the fields of spacecraft instrumentation.

The foregoing description and drawings should be considered as illustrative only of the principles of the invention. The invention may be configured in a variety of shapes and sizes and is not intended to be limited by the preferred embodiment. Numerous applications of the invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

The invention claimed is:

1. A method for controlling synchronization of impulse-bits produced by a multi-element pulsed plasma thruster system, the method comprising:

generating at a processing device, a plurality of independent event markers associated with a plurality of events, the plurality of events including:

a first Trigger Pulse activation event, a first Trigger Pulse deactivation event, a first Magnetic Coil activation event, a first Magnetic Coil deactivation event, and a first End of Cycle signal event corresponding to a first plasma power unit; and a second Trigger Pulse activation event, a second Trigger Pulse deactivation event, a second Magnetic Coil activation event, a second Magnetic Coil deactivation event, and a second End of Cycle signal event corresponding to a second plasma power unit; and adjusting the plurality of independent event markers to synchronize a first impulse-bit associated with the first plasma power unit and a second impulse-bit associated with the second plasma power unit, wherein adjusting the plurality of independent event markers to synchronize the first impulse-bit and the second impulse-bit occurs during the first impulse-bit.

2. The method of claim 1, wherein adjusting the plurality of independent event markers to synchronize the first impulse-bit and the second impulse-bit includes changing timings of one or more of the first Trigger Pulse activation event, the first Trigger Pulse deactivation event, the first Magnetic Coil activation event, the first Magnetic Coil deactivation event, and the first End of Cycle signal event to shorten the first impulse-bit.

3. The method of claim 1, further comprising:

generating at the processing device, a time-slice count, wherein each of the plurality of independent event markers corresponds to a unique count value;

triggering at the processing device, a particular event of the plurality of events in response to the time-slice count equaling a particular independent event marker associated with the particular event; and, incrementing at the processing device, the time-slice count.

4. The method of claim 1, wherein operation occurs in real time.

5. The method of claim 3, wherein adjusting the plurality of independent event markers includes modifying, at the processing device, a particular unique count value corresponding to one of the plurality of independent event markers.

6. A system for controlling controlling synchronization of impulse-bits produced by a multi-element pulsed plasma thruster system, the system comprising:

a processing device configured to:

generate a plurality of independent event markers associated with a plurality of events, the plurality of events including:

a first Trigger Pulse activation event, a first Trigger Pulse deactivation event, a first Magnetic Coil activation event, a first Magnetic Coil deactivation event, and a first End of Cycle signal event corresponding to a first plasma power unit; and a second Trigger Pulse activation event, a second Trigger Pulse deactivation event, a second Magnetic Coil activation event, a second Magnetic Coil deactivation event, and a second End of Cycle signal event corresponding to a second plasma power unit; and adjust the plurality of independent event markers to synchronize a first impulse-bit associated with the first plasma power unit and a second impulse-bit associated with the second plasma power unit, wherein said processing device is configured to adjust the plurality of independent event markers based on a skew between a third impulse-bit associated with the first plasma power unit and a fourth impulse-bit associated with the second plasma power unit.

7. A system for controlling controlling synchronization of impulse-bits produced by a multi-element pulsed plasma thruster system, the system comprising:

a processing device configured to:

generate a plurality of independent event markers associated with a plurality of events, the plurality of events including:

a first Trigger Pulse activation event, a first Trigger Pulse deactivation event, a first Magnetic Coil activation event, a first Magnetic Coil deactivation event, and a first End of Cycle signal event corresponding to a first plasma power unit; and a second Trigger Pulse activation event, a second Trigger Pulse deactivation event, a second Magnetic Coil activation event, a second Magnetic Coil deactivation event, and a second End of Cycle signal event corresponding to a second plasma power unit; and adjust the plurality of independent event markers to synchronize a first impulse-bit associated with the first plasma power unit and a second impulse-bit associated with the second plasma power unit, wherein the processing device is configured to adjust the plurality of independent event markers after each impulse-bit associated with the first plasma power unit or the second plasma power unit.

8. The system of claim 6, said processing device further configured to:

generate a time-slice count, wherein each of the plurality of independent event markers corresponds to counter;

trigger a particular event of the plurality of events in response to the time-slice count equaling a particular independent event marker associated with the particular event; and, increment the time-slice count.

9. The system of claim 6, wherein operation occurs in real time.

10. The system of claim 8, wherein synchronizing the first impulse-bit and the second impulse-bit includes setting one or more event markers associated with the first impulse-bit to different values than corresponding event markers associated with the second impulse-bit.

11. A system for controlling trigger pulse generation in a pulsed plasma thruster system, the system comprising:

a plurality of plasma power units (PPU) including a first PPU and a second PPU;

a primary power distribution device;

at least one backup power distribution device a plurality of thrusters, each of the plurality of thrusters connected to a respective one of the plurality of PPUs; and a processing device configured to generate a plurality of independent event markers associated with a plurality of events, the plurality of events including:

a first activation event and a first deactivation event; and a second activation event and a second deactivation event; and adjust the plurality of independent event markers to synchronize a first impulse-bit associated with the first PPU and a second impulse-bit associated with the second PPU, said processing device configured to control sequencing and phasing of operations of the primary power distribution device and the at least one backup power distribution device based on the plurality of independent event markers.

12. The system of claim 11, further comprising a primary power switch and at least one backup power switch, said processing device configured to control sequencing and phasing of operations of the primary power switch and the at least one backup power switch.

13. The system of claim 11, wherein the plurality of independent event markers correspond to values of a time slice counter.

* * * * *